US012685419B2

(12) United States Patent
Liu et al.

(10) Patent No.: US 12,685,419 B2
(45) Date of Patent: Jul. 21, 2026

(54) RECHARGING METHOD FOR CLEANING ROBOT AND CLEANING ROBOT SYSTEM

(71) Applicant: Qfeeltech (Beijing) Co., Ltd., Beijing (CN)

(72) Inventors: Zhanglin Liu, Beijing (CN); Wulin Tian, Beijing (CN)

(73) Assignee: Qfeeltech (Beijing) Co., Ltd., Beijing (CN)

( * ) Notice: Subject to any disclaimer, the term of this patent is extended or adjusted under 35 U.S.C. 154(b) by 367 days.

(21) Appl. No.: 18/520,540

(22) Filed: Nov. 27, 2023

(65) Prior Publication Data

US 2024/0090731 A1 Mar. 21, 2024

Related U.S. Application Data

(63) Continuation of application No. PCT/CN2022/089142, filed on Apr. 26, 2022.

(30) Foreign Application Priority Data

May 28, 2021 (CN) ..... 202110606579.6

(51) Int. Cl.
*A47L 11/40* (2006.01)
*A47L 11/24* (2006.01)

(52) U.S. Cl.
CPC ..... *A47L 11/4005* (2013.01); *A47L 11/24* (2013.01); *A47L 2201/022* (2013.01); *A47L 2201/04* (2013.01)

(58) Field of Classification Search
CPC ..... A47L 9/2873; A47L 2201/04; A47L 2201/022; A47L 11/24; A47L 11/4005
(Continued)

(56) References Cited

U.S. PATENT DOCUMENTS 11,199,853 B1 * 12/2021 Afrouzi ..... B25J 5/00
2012/0296511 A1 * 11/2012 More ..... G05D 1/0242 901/1
2020/0305670 A1 * 10/2020 Kim ..... A47L 9/2826

FOREIGN PATENT DOCUMENTS

CN 103251355 A 8/2013
CN 106026288 A 10/2016
(Continued)

OTHER PUBLICATIONS

International Search Report and Written Opinion issued on Jun. 28, 2022, in PCT/CN2022/089142, filed on Apr. 26, 2022, and English machine translation (14 pages).

*Primary Examiner* — Katina N. Henson
(74) *Attorney, Agent, or Firm* — Alleman Hall LLP

(57) ABSTRACT

A recharging method for a cleaning robot is provided. The recharging method includes: determining a direction of a charging base; controlling the cleaning robot to move in a first direction toward the direction of the charging base; detecting, in real time, a distance between the cleaning robot and the charging base; determining whether the cleaning robot has arrived at a target location based on the distance, the target location being at a second distance in front of the charging base; controlling the cleaning robot to rotate for a predetermined angle when the cleaning robot arrives at the target location; controlling the cleaning robot to move backwardly to approach the charging base and to touch the charging base; controlling the cleaning robot to move forwardly for a first distance, and then to move backwardly to approach the charging base and to dock with the charging base to perform battery charging.

20 Claims, 20 Drawing Sheets

(58) Field of Classification Search
USPC ..... 15/3
See application file for complete search history.

(56) References Cited

FOREIGN PATENT DOCUMENTS

| | | | |
|---|---|---|---|
| CN | 108390441 | A | 8/2018 |
| CN | 109974727 | A | 7/2019 |
| CN | 111427361 | A | 7/2020 |
| CN | 112731924 | A | 4/2021 |
| JP | 2007193473 | A | 8/2007 |

* cited by examiner

RECHARGING METHOD FOR CLEANING ROBOT AND CLEANING ROBOT SYSTEM

CROSS REFERENCE TO RELATED APPLICATIONS

This application is a continuation of International Application No. PCT/CN2022/089142, filed on Apr. 26, 2022, which claims priority to Chinese Patent Application Number 202110606579.6, filed on May 28, 2021 in Chinese Patent Office, and titled "Recharging Method for Cleaning Robot and Cleaning Robot System," the entire contents of all of the above-referenced applications are incorporated herein by reference.

TECHNICAL FIELD

The present disclosure relates to the technical field of cleaning robots, and more specifically, to a recharging method for a cleaning robot and a cleaning robot system.

BACKGROUND

As the advancement of technology, home appliances used in people's daily lives are also advancing toward a direction of being intelligent. Cleaning robots have been widely used in the cleaning tasks of offices and homes, for example, cleaning robots may be used to clean a floor.

In related technology, a cleaning robot may automatically move to a charging base to perform battery charging after having worked for a period of time. Typically, after being supplied with the electric power, the charging base can constantly transmit a recharging guidance signal. When the cleaning robot needs to recharge, a recharging sensor receives the recharging guidance signal transmitted by the charging base, and moves to the charging base to perform battery charging under the guidance of the recharging guidance signal.

However, in actual implementation, the following deficiency may exist in conventional technology: sometimes the docking between the cleaning robot and the charging base may not be accurate, which may cause the recharging to fail.

SUMMARY OF THE DISCLOSURE

Embodiments of the present disclosure provide a recharging method for a cleaning robot and a cleaning robot system, which solve issues relating to the existing technology, where the docking between the cleaning robot and the charging base is not accurate, which causes the recharging to fail.

According to a first aspect of the embodiments of the present disclosure, a recharging method for a cleaning robot is provided. The recharging method includes:

- determining a direction of a charging base;
- controlling the cleaning robot to move in a first direction toward the direction of the charging base to approach the charging base;
- detecting, in real time, a distance between the cleaning robot and the charging base;
- determining whether the cleaning robot has arrived at a target location based on the distance between the cleaning robot and the charging base, the target location being at a second predetermined distance in front of the charging base;
- controlling the cleaning robot to rotate for a predetermined angle when the cleaning robot arrives at the predetermined target location;

- controlling the cleaning robot to move backwardly toward the charging base to touch the charging base;
- controlling the cleaning robot to move forwardly for a first predetermined distance;
- controlling the cleaning robot to move backwardly toward the charging base to dock with the charging base to perform battery charging.

According to a second aspect of the embodiments of the present disclosure, a cleaning robot system is provided. The cleaning robot system includes: a charging base and a cleaning robot. The cleaning robot includes:

- a determination device configured to determine a direction of the charging base;
- a motion device configured to move the cleaning robot;
- a detection device configured to detect, in real time, a distance between the cleaning robot and the charging base;
- a controller configured to: control the cleaning robot to move in a first direction toward the direction of the charging base to approach the charging base; determine whether the cleaning robot has arrived at a target location based on the distance between the cleaning robot and the charging base, the target location being at a second predetermined distance in front of the charging base,
- the controller is also configured to: control the cleaning robot to rotate for a predetermined angle when the cleaning robot arrives at the predetermined target location; control the cleaning robot to move backwardly toward the charging base, to touch the charging base; control the cleaning robot to move forwardly for a first predetermined distance; control the cleaning robot to move backwardly toward the charging base to dock with the charging base to perform battery charging.

According to a third aspect of the embodiments of the present disclosure, a recharging method for a cleaning robot is provided. The recharging method includes:

- transmitting, by a transmitter on the charging base, a recharging guidance signal and a first proximity signal, the first proximity signal being transmitted during a transmission gap between transmissions of the recharging guidance signal, the recharging guidance signal being receivable by a recharging sensor of the cleaning robot, the first proximity signal being receivable by a receiver of a proximity sensor of the cleaning robot;
- when the cleaning robot enters a recharging phase, controlling, by a controller, the cleaning robot to shut down a transmitter of the proximity sensor of the cleaning robot, and to maintain an open state of the receiver of the proximity sensor;
- receiving, by the receiver of the proximity sensor of the cleaning robot, the first proximity signal, and detecting, by the controller or the proximity sensor, a distance between the cleaning robot and the charging base based on the first proximity signal;
- controlling, by the controller, the cleaning robot to approach the charging base based on the distance between the cleaning robot and the charging base, and to dock with the charging base to perform battery charging.

According to a fourth aspect of the embodiments of the present disclosure, a cleaning robot is provided. The cleaning robot includes:

- a recharging sensor configured to receive a recharging guidance signal transmitted by a charging base;

a proximity sensor configured to detect, through a contactless manner, surrounding obstacles of the cleaning robot, the proximity sensor including a transmitter and a receiver, wherein, when the cleaning robot enters a recharging phase, the cleaning robot shuts down the transmitter of the proximity sensor, and maintains an open state of the receiver of the proximity sensor;

the receiver of the proximity sensor of the cleaning robot receives the first proximity signal, and the proximity sensor or a controller detects, in real time, a distance between the cleaning robot and the charging base based on the first proximity signal;

the cleaning robot approaches the charging base based on the distance between the cleaning robot and the charging base, and docks with the charging base to perform battery charging.

According to a fifth aspect of the embodiments of the present disclosure, a charging base is provided. The charging base includes: a transmitter;

the transmitter transmits a recharging guidance signal and a first proximity signal, the first proximity signal being transmitted during a transmission gap between transmissions of the recharging guidance signal, the first proximity signal being receivable by a receiver of the proximity sensor of the cleaning robot; the recharging guidance signal being receivable by a recharging sensor of the cleaning robot.

According to a sixth aspect of the embodiments of the present disclosure, a cleaning robot system is provided. The cleaning robot system includes: a cleaning robot and a charging base;

the charging base includes a transmitter configured to transmit a recharging guidance signal and a first proximity signal, the first proximity signal being transmitted during a transmission gap between transmissions of the recharging guidance signal, the recharging guidance signal being receivable by a recharging sensor of the cleaning robot, the first proximity signal being receivable by a receiver of a proximity sensor of the cleaning robot;

the receiver of the proximity sensor of the cleaning robot receives the first proximity signal, and the proximity sensor or the controller detects a distance between the cleaning robot and the charging base based on the first proximity signal; the cleaning robot approaches the charging base based on the distance between the cleaning robot and the charging base, and docks with the charging base to perform battery charging; wherein, when the cleaning robot enters a recharging phase, the transmitter of the proximity sensor is shut down, and the receiver of the proximity sensor maintains an open state.

According to a seventh aspect of the embodiments of the present disclosure, a cleaning apparatus is provided. The cleaning apparatus includes: at least one processor and a storage device;

the storage device is configured to store computer-executable instructions;

the at least one processor is configured to execute the computer-executable instructions stored in the storage device, such that the recharging method for the cleaning robot according to the first aspect or the third aspect of the embodiments of the present disclosure is performed.

According to an eighth aspect of the embodiments of the present disclosure, a non-transitory computer-readable storage medium is provided. The non-transitory computer-readable storage medium stores computer-executable instructions. When a processor executes the computer-readable instructions, the recharging method for the cleaning robot according to the first aspect or the third aspect of the embodiments of the present disclosure is performed.

The embodiments of the present disclosure realize accurate docking between charging terminals (e.g., charging plates) of the cleaning robot and corresponding charging terminals (e.g., charging contact points) of the charging base (this process is also referred to as the cleaning robot boarding the charging base), such that the cleaning robot can automatically perform battery charging, thereby significantly reducing the recharging failure rate caused by inaccuracy in the process of the cleaning robot boarding the charging base, and increasing the success rate of the recharging.

The embodiments of the present disclosure provide a recharging method and a system for a cleaning robot, which utilizes a transmitter on a charging base to transmit a first proximity signal during a transmission gap between transmissions of a recharging guidance signal, such that when a receiver of a proximity sensor of the cleaning robot receives the first proximity signal or receives the first proximity signal having a sufficient strength, the cleaning robot determines an approximate distance between the cleaning robot and the charging base, which enables the cleaning robot to perform a reliable recharging process based on the distance between the cleaning robot and the charging base.

BRIEF DESCRIPTION OF THE DRAWINGS

To explain more clearly the technical solutions of the present disclosure or of the existing technologies, the accompanying drawings that are used in the description of the embodiments or the existing technologies are briefly introduced. Obviously, the accompanying drawings described below show some embodiments of the present disclosure. For a person having ordinary skills in the art, other accompanying drawings may be obtained based on these accompanying drawings without expending creative effort.

Figure 7:
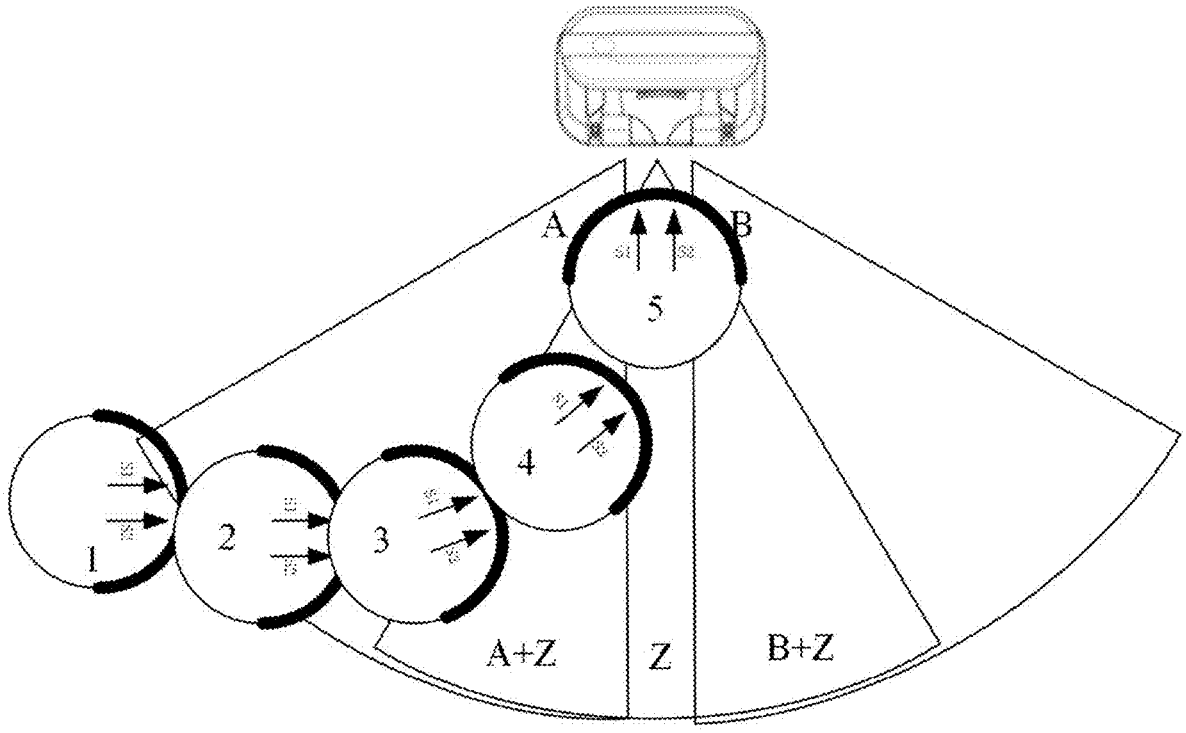
Figure 8:
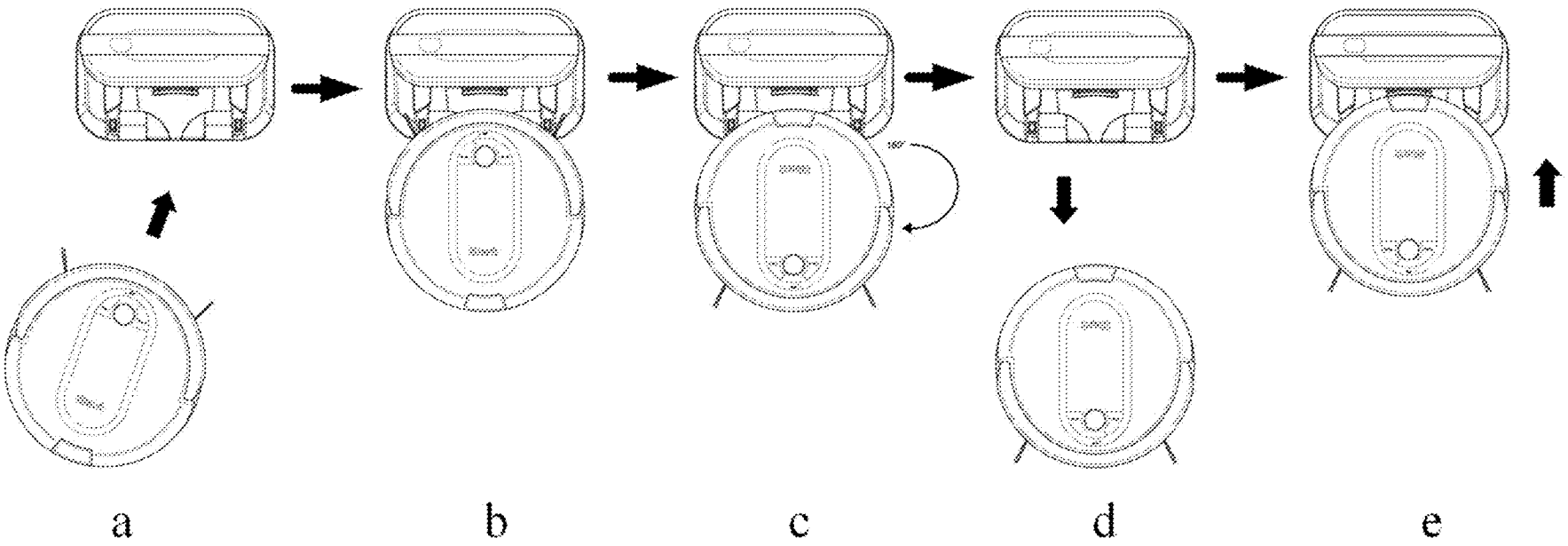
Figure 9:
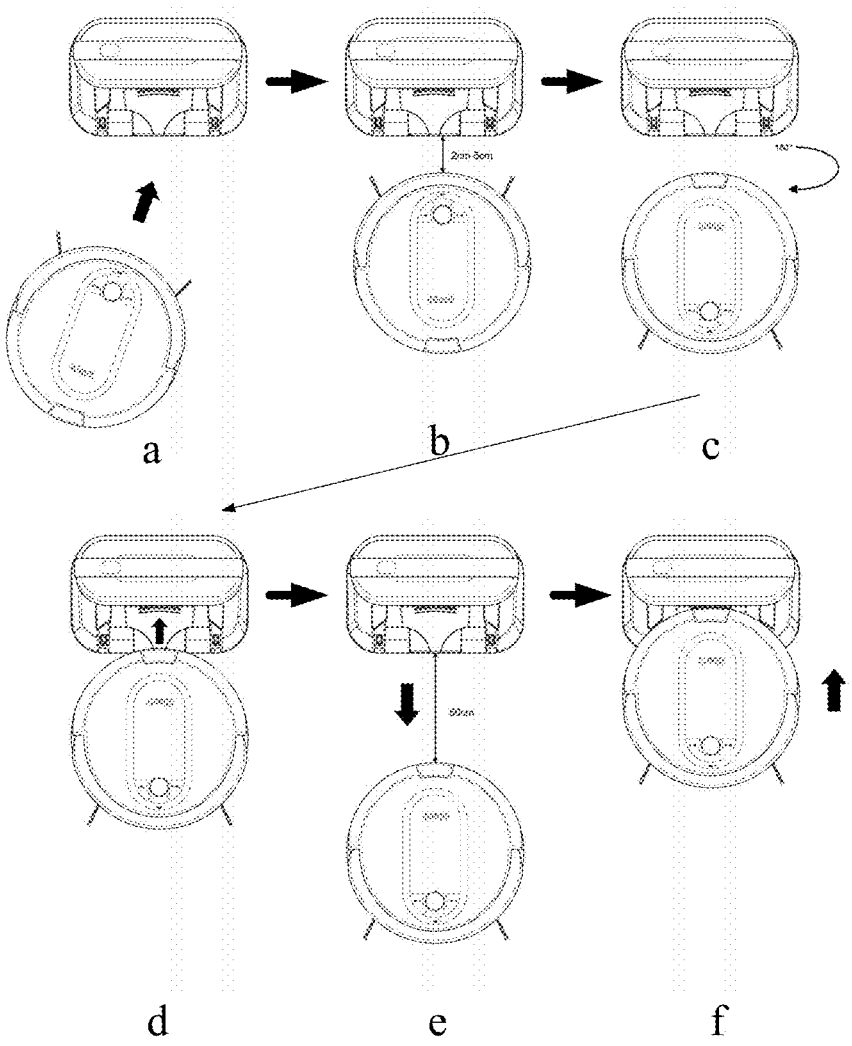
Figure 10:
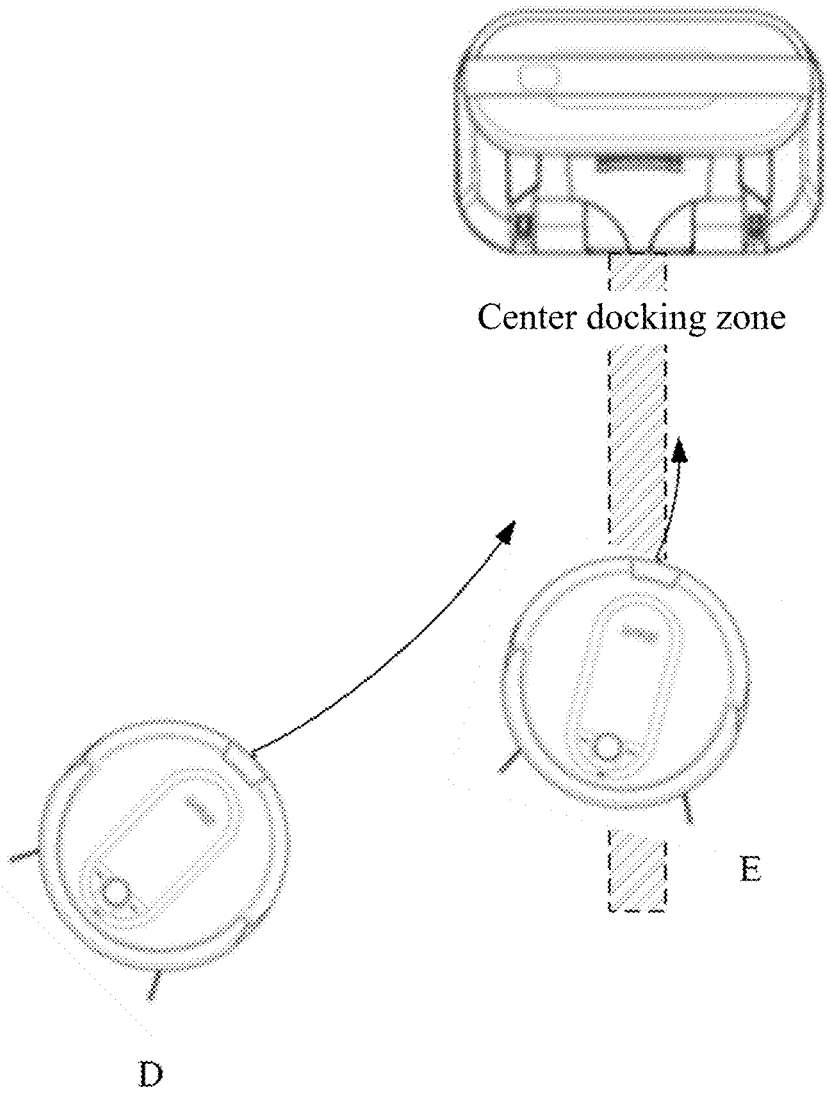
Figure 11:
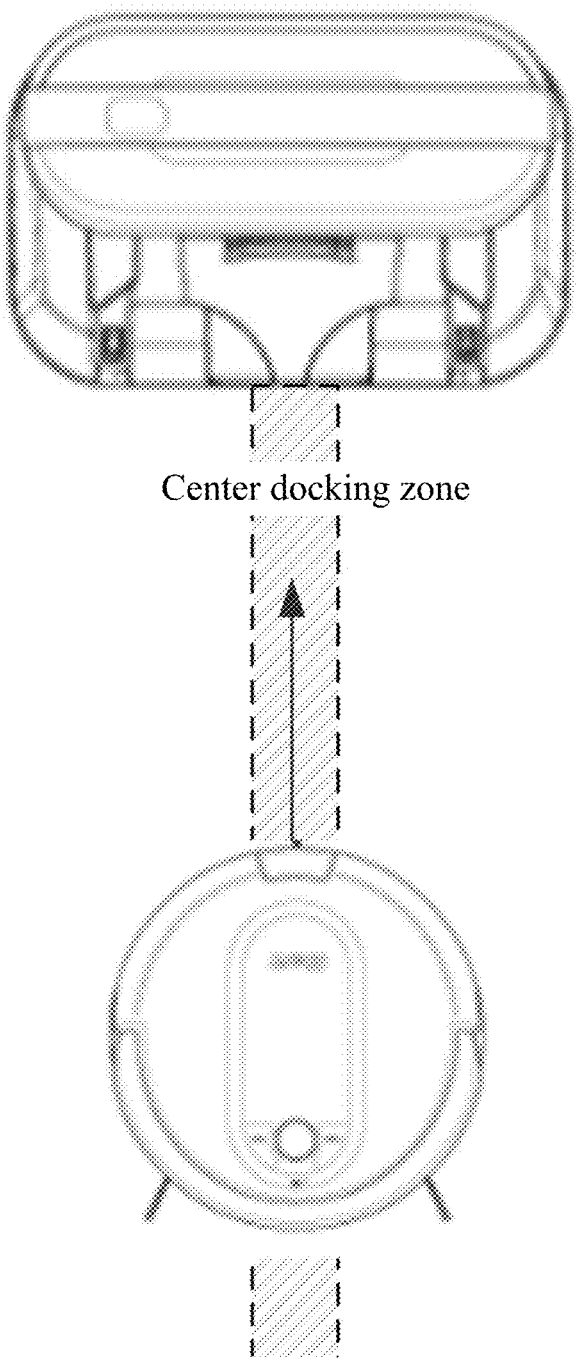
Figure 12:
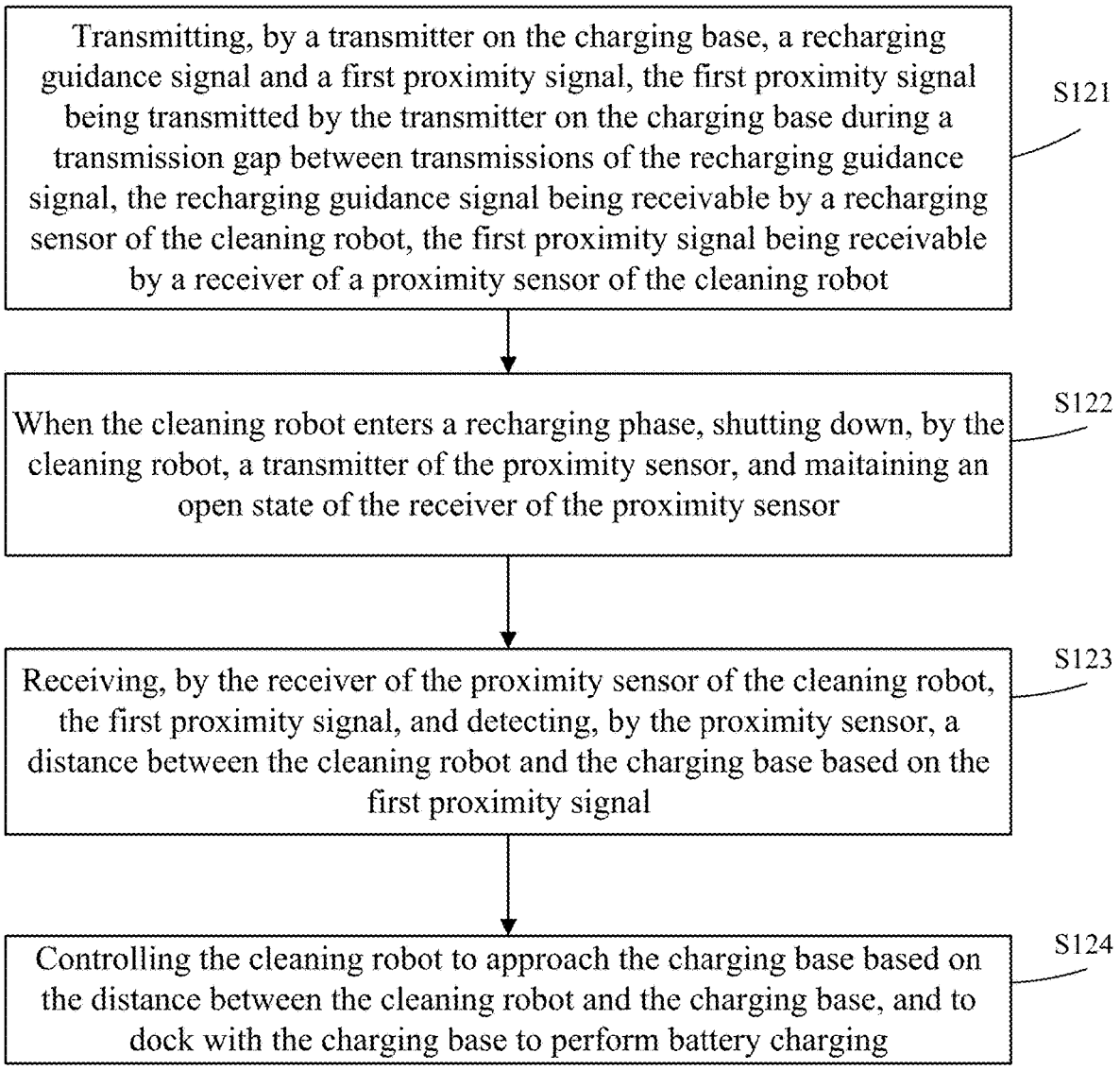
Figure 13:
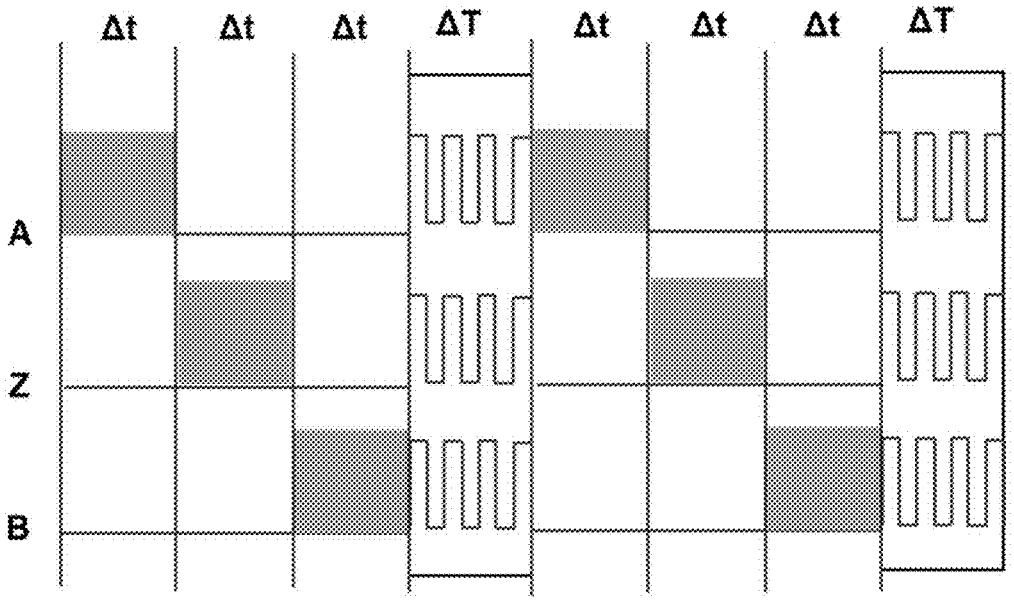
Figure 14:
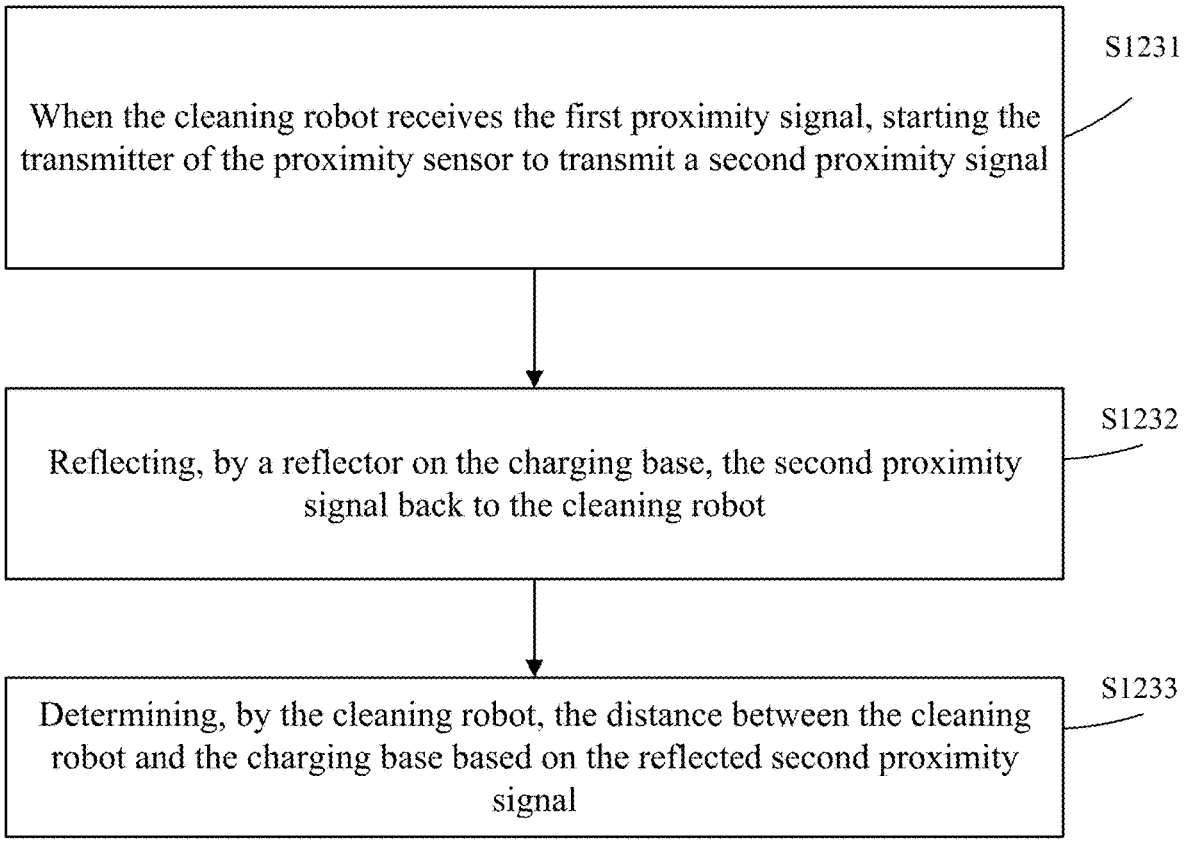
Figure 15:
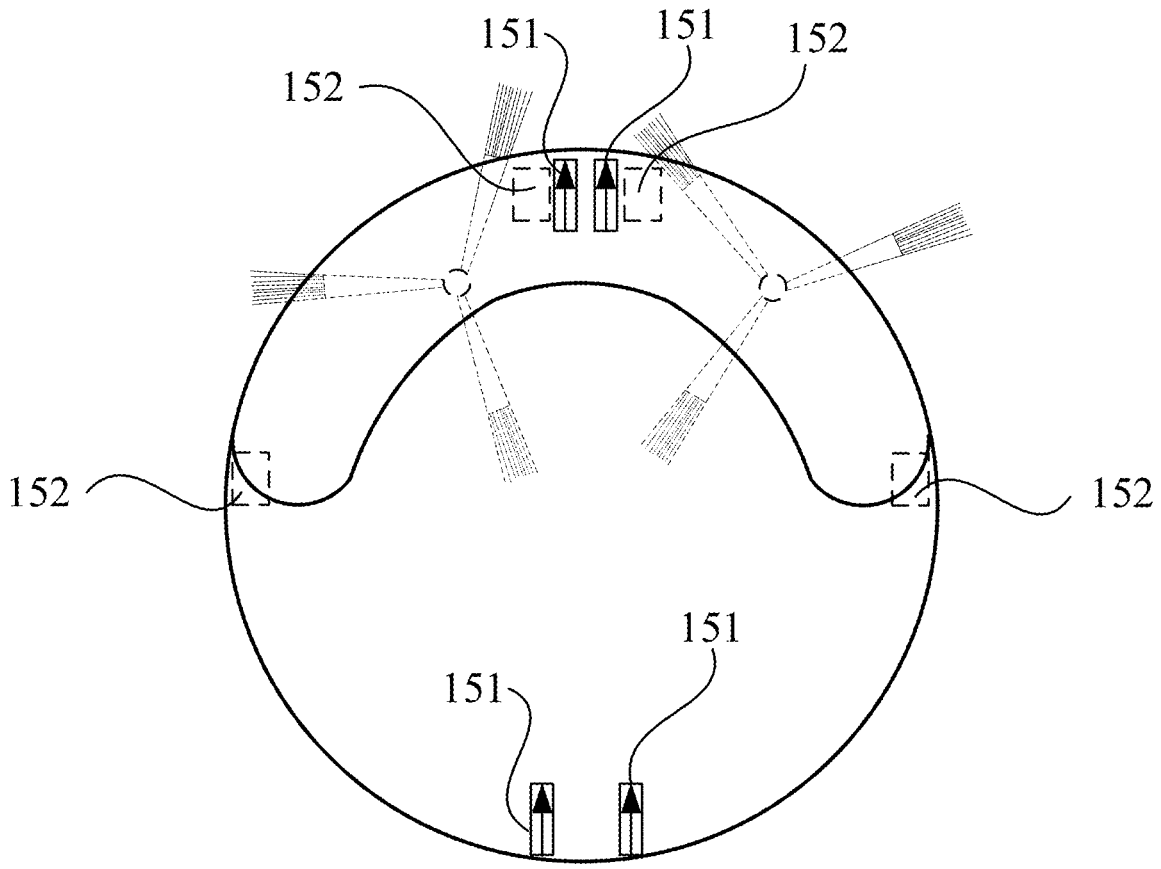
Figure 16:
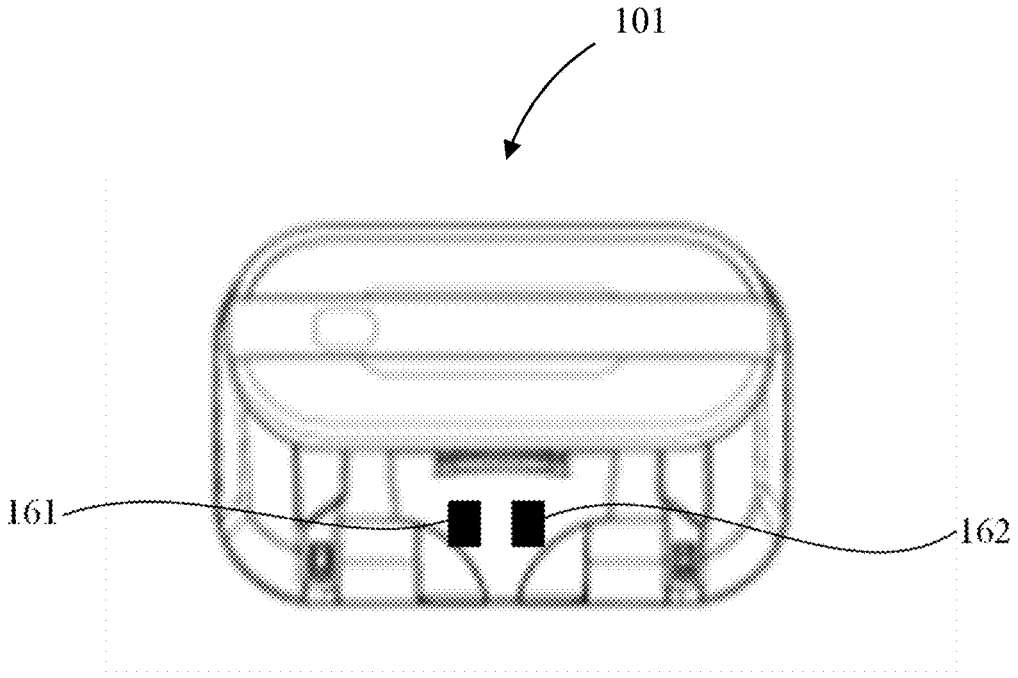
Figure 17:
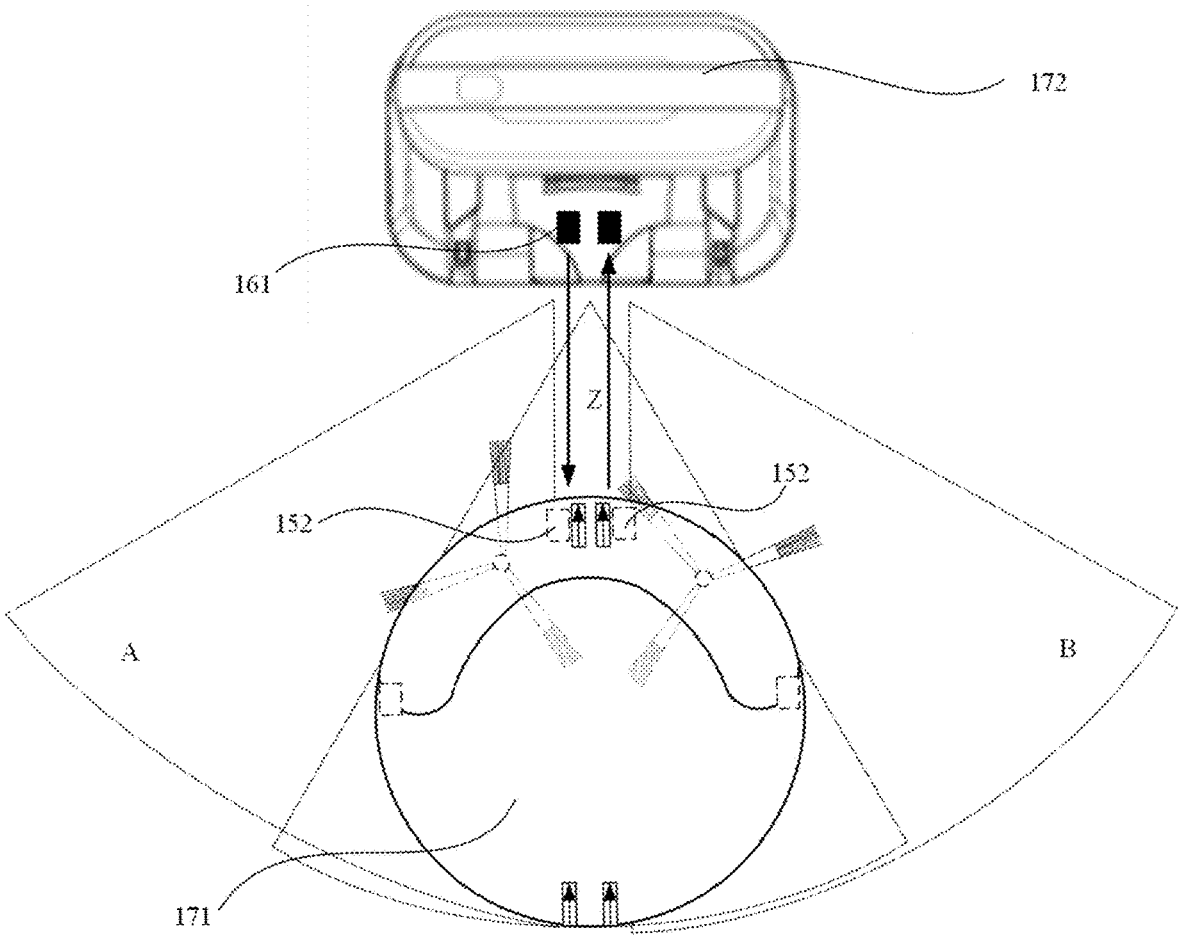
Figure 18:
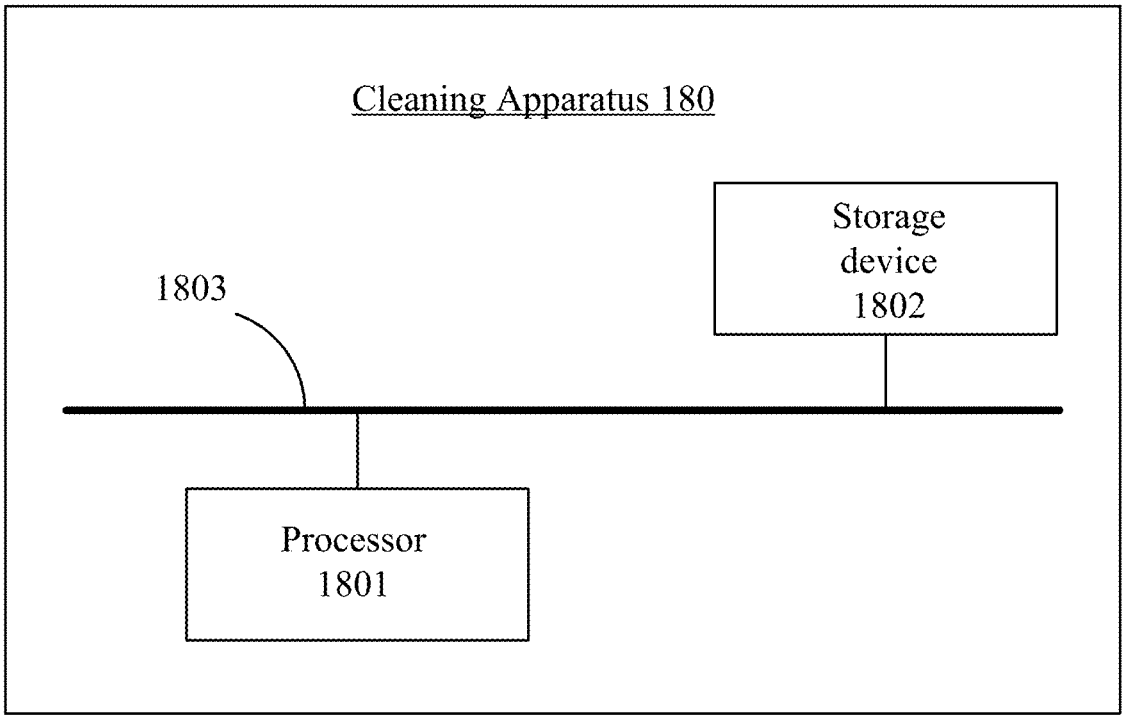
Figure 19:
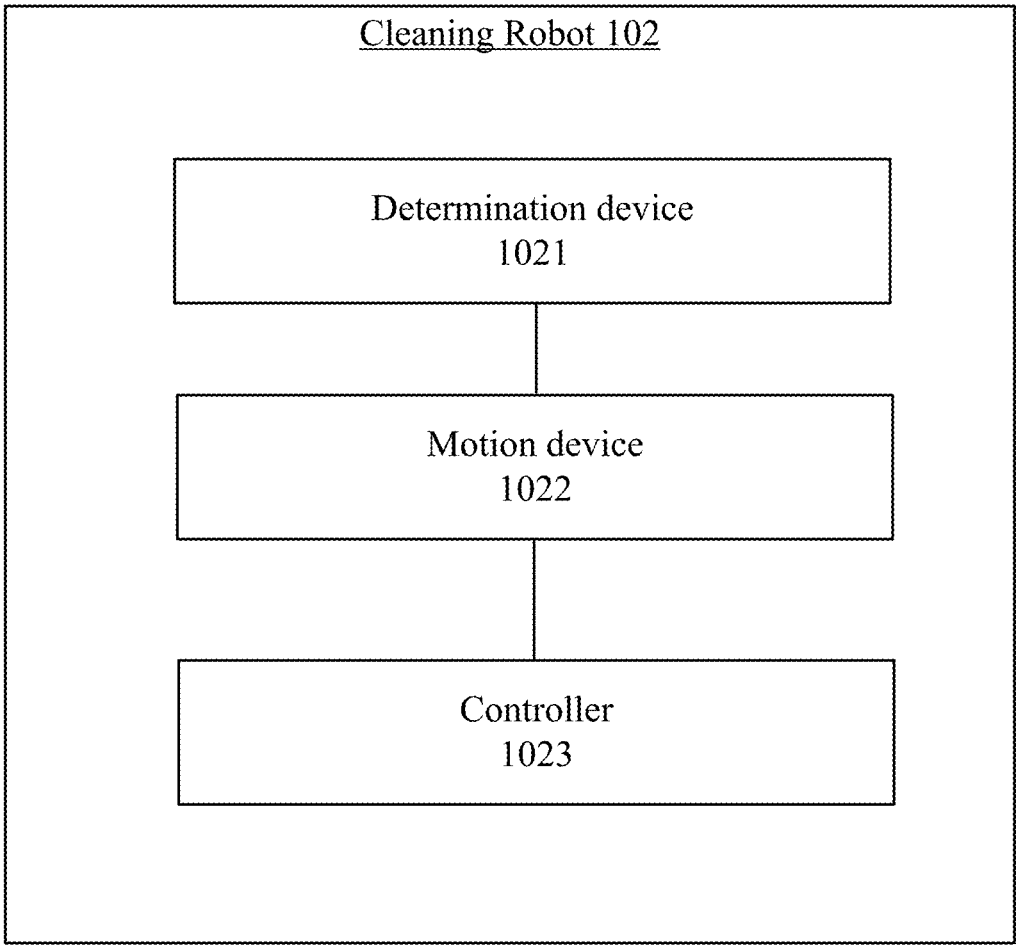

FIG. **6*a*** is a schematic illustration of coverage of a directional signal transmitted by the charging base, according to an embodiment of the present disclosure;

FIG. **6*b*** is a schematic illustration of a location of a central axis of the cleaning robot, according to an embodiment of the present disclosure;

FIG. 7 is a schematic illustration of a process of the cleaning robot moving toward the charging base, according to an embodiment of the present disclosure;

FIG. 8 is a schematic illustration of a process of the cleaning robot docking with the charging base, according to an embodiment of the present disclosure;

FIG. 9 is a schematic illustration of a process of the cleaning robot docking with the charging base, according to another embodiment of the present disclosure;

FIG. 10 is a schematic illustration of a process of the cleaning robot moving toward the charging base, according to another embodiment of the present disclosure;

FIG. 11 is a schematic illustration of a process of the cleaning robot moving toward the charging base, according to another embodiment of the present disclosure;

FIG. 12 is a flowchart illustrating a recharging method for a cleaning robot, according to another embodiment of the present disclosure;

FIG. 13 is a schematic illustration of the charging base transmitting signals, according to an embodiment of the present disclosure;

FIG. 14 is a flowchart illustrating a method for calculating a distance between the cleaning robot and the charging base, according to another embodiment of the present disclosure;

FIG. 15 is a schematic illustration of a structure of a cleaning robot, according to an embodiment of the present disclosure;

FIG. 16 is a schematic illustration of a structure of a charging base according to an embodiment of the present disclosure;

FIG. 17 is a schematic illustration of a structure of a cleaning robot system, according to an embodiment of the present disclosure;

FIG. 18 is a schematic illustration of a structure of a cleaning apparatus, according to an embodiment of the present disclosure; and FIG. 19 is a schematic diagram showing structure of a cleaning robot, according to an embodiment of the present disclosure.

DETAILED DESCRIPTION

In order to make the objective of the present disclosure, the technical solutions and advantages clearer, next, the technical solutions of the present disclosure will be clearly and comprehensively described with reference to the accompanying drawings of the present disclosure. Obviously, the described embodiments are some embodiments of the present disclosure, and are not all of the embodiments. Based on the embodiments of the present disclosure, a person having ordinary skills in the art can obtain all other embodiments without expending creative effort, which all belong to the scope of protection of the present disclosure.

Terms such as "first," "second," "third," and "fourth," etc. (if any) used in the specification, the claims, and the drawings of the present disclosure are for the purpose of differentiating similar objects, and are not necessarily used to describe a specific order, or proceeding and subsequent orders. Data modified by such terms should be understood as being interchangeable, such that the embodiments of the present disclosure described herein can be implemented using orders other than those illustrated or described herein. In addition, the terms "comprise/include" and "have/has" and their variations are intended to cover non-exclusive inclusion. For example, processes, methods, systems, products or apparatus that include a series of steps or units are not limited to the explicitly listed steps or units, but may also include other steps or units that have not been explicitly listed or that are inherent to the processes, methods, products or apparatus.

Figure 1:
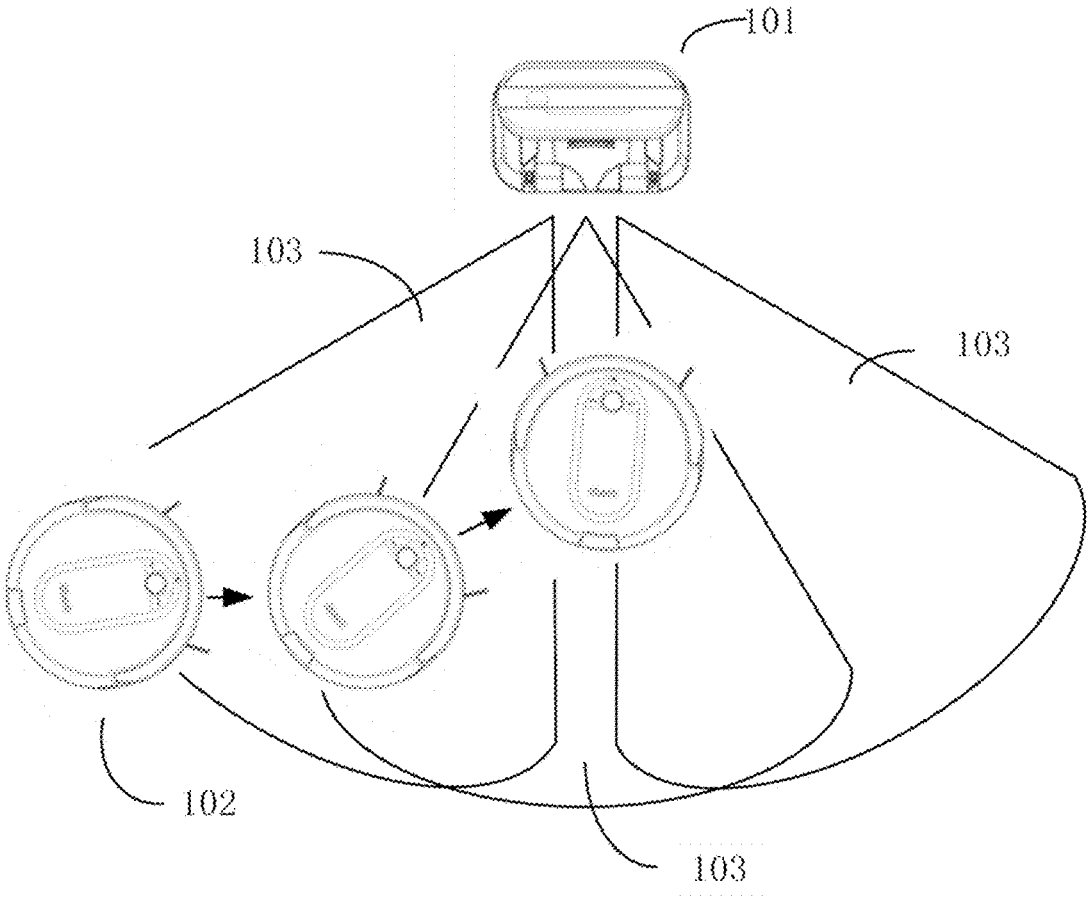
FIG. 1 is a schematic illustration of an application scene of a recharging method for a cleaning robot, according to an existing technology.

FIG. 1 is a schematic illustration of an application scene of a recharging method for a cleaning robot, according to an existing technology. In existing technology, as the advancement of the technology, home appliances used in people's daily life are gradually advancing in a direction toward being intelligent. Cleaning robots are widely used in the cleaning tasks of offices and homes. For example, cleaning robots can be used to clean floors. In related technology, a cleaning robot 102 detects that battery charging is needed after having worked for a period of time. The cleaning robot 102 may automatically move to a charging base 101 to perform battery charging (the process of the cleaning robot boarding the charging base). In the present disclosure, the process of the cleaning robot returning to the charging base to perform charging is referred to as a recharging process. After an electric power is supplied to the charging base 101, the charging base 101 constantly transmits a recharging guidance signal, which forms a recharging guidance signal covering zone 103; a recharging sensor specifically configured to receive the recharging guidance signal is provided on the cleaning robot 102. The recharging sensor searches for and receives the recharging guidance signal when needed. The cleaning robot 102 approaches the charging base 101 under the guidance of the recharging guidance signal, and moves onto the charging base 101 to perform battery charging, as shown in FIG. 1. For the cleaning robot 102 to smoothly dock with the charging base 101 to realize automatic battery charging, typically, charging plates of cleaning robot 102 installed close to a front portion of the cleaning robot 102 contact charging points of the charging base 101. However, in some situations, charging plates need to be installed at a rear portion of the cleaning robot 102, such that the rear portion of the cleaning robot 102 docks with the charging base 101 for realizing automatic battery charging. For such type of cleaning robots, contacting plates installed at the rear portion may have difficulty in successfully docking with the charging contact points of the charging base, which can cause the recharging to fail.

To address these deficiencies of the existing technology, the main principle of the present disclosure is: the cleaning robot first determines a direction of the charging base, and then moves in a first direction toward the direction of the charging base to approach the charging base; when the cleaning robot arrives at a predetermined target location, the cleaning robot rotates for a predetermined angle; after the rotation, the cleaning robot moves forwardly for a first predetermined distance, then moves backwardly toward the charging base, thereby realizing the rear portion of the cleaning robot docking with the charging base such that the cleaning robot can perform automatic battery charging. Because when the cleaning robot arrives at the target location, the cleaning robot first rotates for the predetermined angle, then moves in the forward direction for a distance (i.e., moves away from the charging base), then moves backwardly to approach the charging base, these processes leave a relatively longer distance for the cleaning robot to adjust its pose more accurately, thereby increasing the success rate of accurate docking between the charging plates of the cleaning robot disposed at the rear portion of the cleaning robot and the corresponding charging contact points of the charging base (this process is also referred to as the cleaning robot boarding the charging base), such that the cleaning robot can automatically board the charging base to perform battery charging. The success rate of automatic recharging of the cleaning robot is increased.

Figure 2:
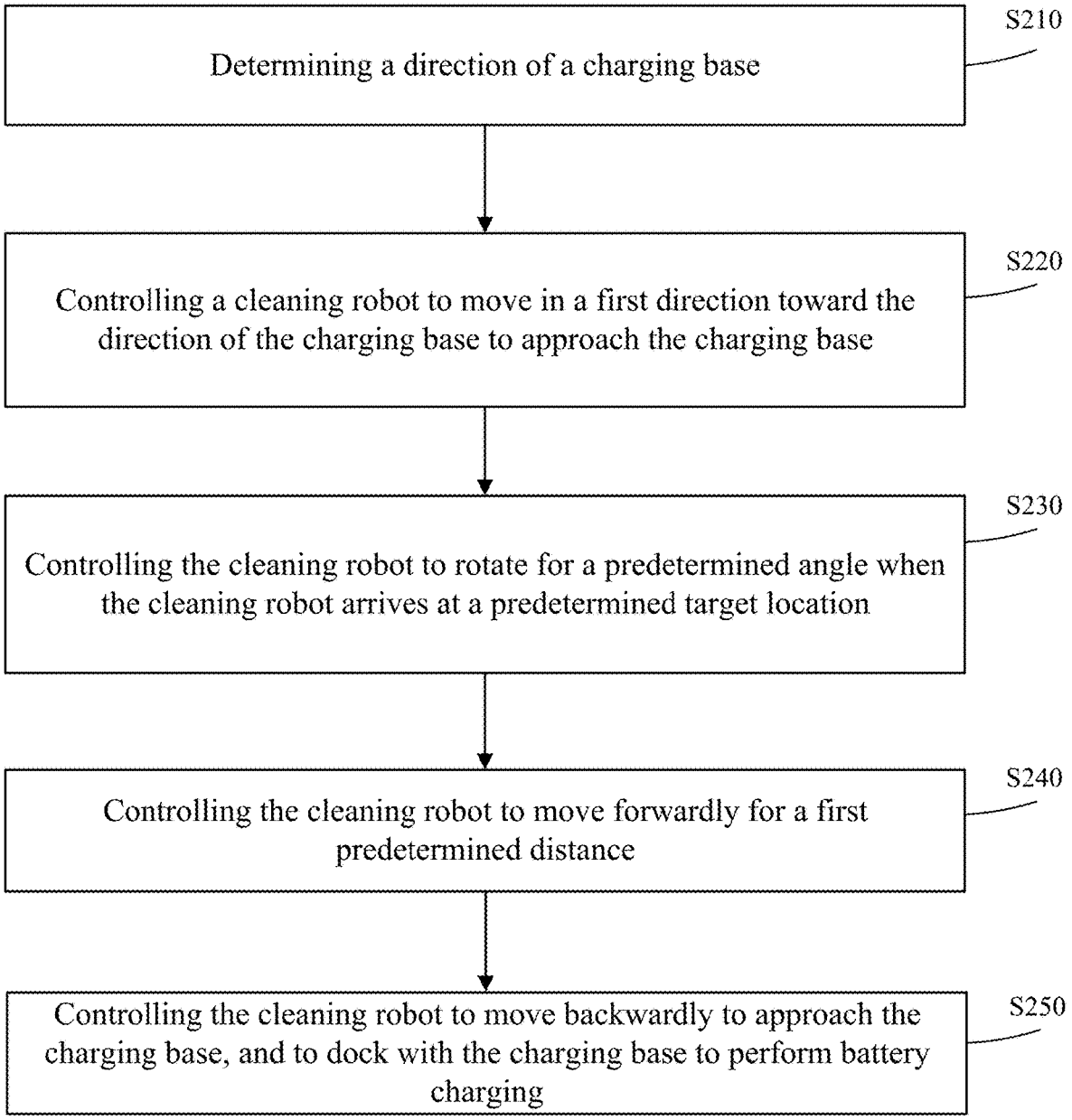
FIG. 2 is a flowchart illustrating a recharging method for a cleaning robot, according to an embodiment of the present disclosure.

FIG. 2 is a flowchart illustrating a recharging method for a cleaning robot, according to an embodiment of the present disclosure. The executing body of the method of this embodiment of the present disclosure may be a cleaning robot.

As shown in FIG. 2, the method of this embodiment may include the following steps.

S210, determining a direction of a charging base.

Figure 6A:
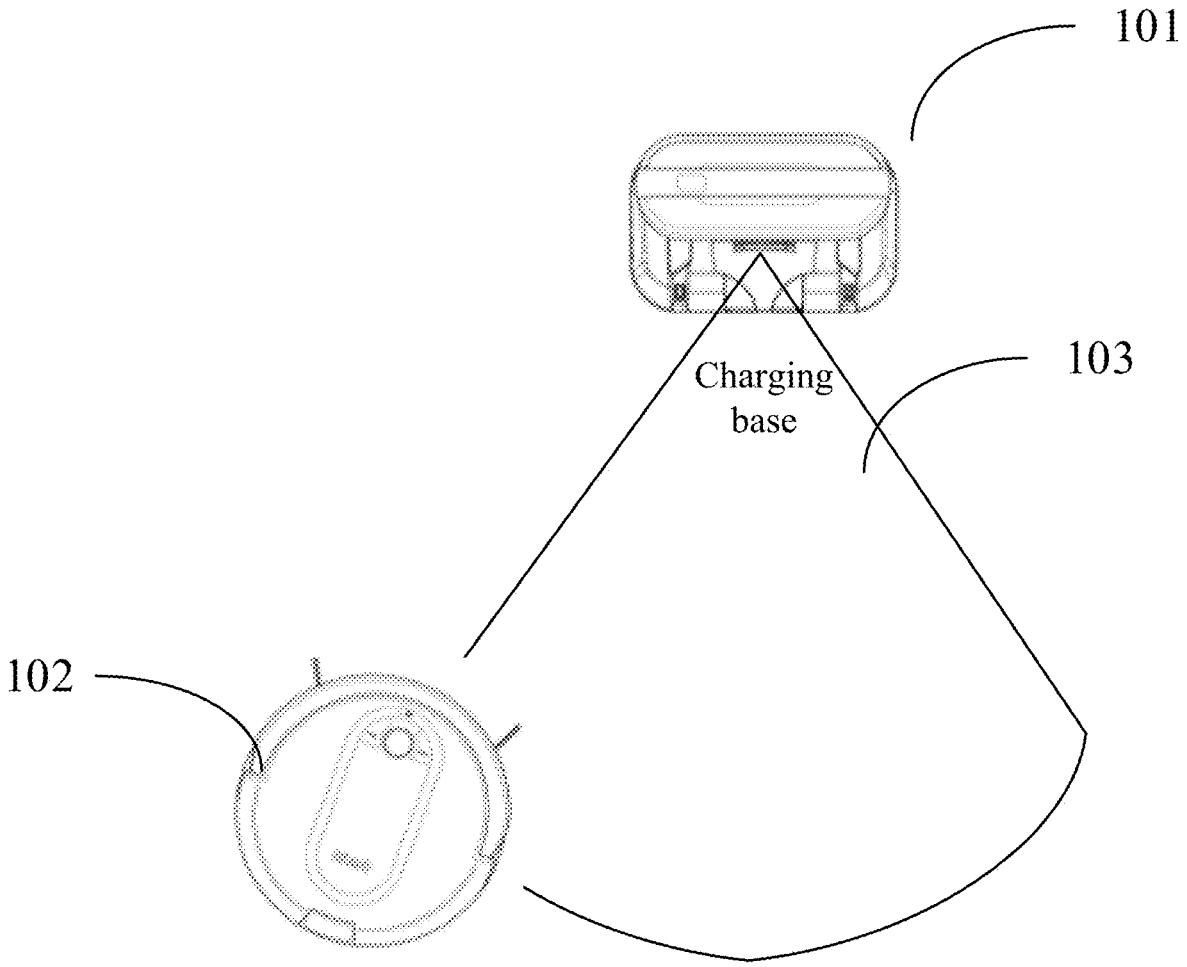

Specifically, in some embodiments, after the charging base is supplied with an electric power, the charging base may constantly transmit a recharging guidance signal. The recharging guidance signal may be a directional guidance signal, such as a Z signal. The coverage scope of the Z signal may be a circular sector shaped zone (as shown in FIG. 6*a*) or a cone shaped zone that has the charging base 101 as a center and a predetermined distance as a radius. The coverage zone of the directional guidance signal may also have an elliptical shape or any other asymmetric shape that may be formed by the coverage scope of the recharging guidance signal. In some embodiments of the present disclosure, the front portion and rear portion of the cleaning robot are respectively provided with multiple recharging sensors that are configured to receive the recharging guidance signal (e.g., infrared sensors configured to receive recharging guidance signals such as high-frequency (e.g., 38 kHz) carrier wave encoding signals, where the carrier wave may be a square wave). When the cleaning robot 102 needs to perform battery charging, the recharging sensor of the cleaning robot may constantly search for the recharging guidance signal transmitted by the charging base 101. When the cleaning robot 102 enters a coverage zone 103 of the recharging guidance signal, the recharging sensor may sense or detect the recharging guidance signal. The cleaning robot may determine a direction of the charging base 101 along the recharging guidance signal. For example, a controller of the cleaning robot may determine the direction of the charging base 101 with respect to the cleaning robot. In some embodiments, a sensor (e.g., a proximity sensor) of the cleaning robot may measure a distance between the cleaning robot and the charging base. Then the cleaning robot may further determine (e.g., through the controller of the cleaning robot) a location of the charging base along the direction of the charging base.

In some embodiments, the cleaning robot may be provided with a camera (e.g., a first camera that faces in an oblique upward direction or in a perpendicular upward direction may be disposed at a top plane of the cleaning robot, and/or a second camera that faces an oblique upward direction or a horizontal forward direction may be disposed at the front portion, and/or a third camera configured to capture images at the back of the cleaning robot may be disposed at the rear portion). Images of the surrounding environment may be captured in real time by the cameras. Location of the charging base may be determined, e.g., by the controller of the cleaning robot, based on the images captured by the cameras.

S220, controlling the cleaning robot to move in a first direction toward the direction of the charging base to approach the charging base.

Specifically, in some embodiments, after the cleaning robot determines the direction of the charging base, the cleaning robot may move in a first direction toward the direction of the charging base, as shown in sub-figure (a) in FIG. 8. The first direction may be a direction in which the cleaning robot forwardly approaches the charging base. That is, the first direction may be the same as the direction of the charging base. During the process of the cleaning robot approaching the charging base, the recharging sensor of the cleaning robot may constantly search for the recharging guidance signal transmitted by the charging base, such that the cleaning robot moves closer and closer to the charging base under the guidance of the recharging guidance signal. In some embodiments, the first direction may be different from the direction of the charging base. Other movement method may be used to cause the cleaning robot to approach the charging base such that the cleaning robot gradually approaches the charging base. For example, the cleaning robot may move forward in an arc or S-shaped curvy movement manner, or, may move forward in a zigzag manner with a turning direction being perpendicular or nearly perpendicular to a connecting line between an initial location of the cleaning robot and the location of the charging base.

S230, controlling the cleaning robot to rotate for a predetermined angle when the cleaning robot arrives at a predetermined target location.

Illustratively, in the following example, the predetermined target location is presumed to be the location of the charging base, and how the cleaning robot arrives at the predetermined target location is explained, i.e., the process of moving from a location "a" to a location "b" as shown in FIG. 8. Referring to FIG. 7, it is presumed that the cleaning robot includes four recharging sensors. The four recharging sensors may be evenly divided into two groups installed at the front portion and rear portion of the cleaning robot, and may be symmetrically disposed at two sides of a central axis of the cleaning robot (referred to as the left side and the right side). In FIG. 7, the arrow on the left on each cleaning robot represents two recharging sensors disposed at the front portion and rear portion of the cleaning robot on the left side (both labeled as s1), and the arrow on the right represents two recharging sensors disposed at the front portion and rear portion of the cleaning robot on the right side (both labeled as s2). After being supplied with an electric power, the charging base may constantly transmit recharging guidance signals. In this embodiment, the recharging guidance signals are signal A, signal B, and signal Z, respectively. The signal Z may be a directional guidance signal that covers a central zone in front of the charging base. The coverage zones of the signal A and signal B may be symmetrically located at two sides of the coverage zone of the signal Z. The signal A and signal B may both have an overlapping zone with the signal Z. The overlapping zones are A+Z (i.e., a zone that is covered by the signal A and the signal Z at the same time) and B+Z (i.e., a zone that is covered by the signal B and the signal Z at the same time). Between the two overlapping zones is a separate zone that is covered only by signal Z, i.e., a center docking zone. The two recharging sensors located at the front portion of the cleaning robot may search for the recharging guidance signals transmitted by the charging base. When the cleaning robot enters the coverage zones of the recharging guidance signals, a motion pose of the cleaning robot may be adjusted based on the types of the recharging guidance signals sensed by the two recharging sensors.

Next, a specific example with reference to FIG. 7 is used to explain the process of the cleaning robot moving to the charging base. When the cleaning robot moves to location number 1, a front-left recharging sensor s1 (i.e., the recharging sensor located at the front portion on the left side) of the cleaning robot may sense the signal A, and a front-right recharging sensor s2 (i.e., the recharging sensor located at the front portion on the right side) of the cleaning robot may not sense the signal A, then the cleaning robot may slightly turn counter-clockwise for a certain angle while moving forwardly. The cleaning robot may move to location number 2. At this moment, both of the two recharging sensors s1 and s2 located at the front portion may detect the signal A. Then, the two recharging sensors may continue to search for an overlapping zone of the signal A and the signal Z. When the cleaning robot moves to location number 3, the two recharging sensors s1 and s2 located at the front portion may both detect the signal A and the signal Z. Subsequently, the cleaning robot may continue to move forwardly. When the cleaning robot moves to location number 4, the front-right recharging sensor s2 has left the coverage zone of the signal A, and can only sense the signal Z. At this moment, the front-left recharging sensor s1 is still located inside the overlapping zone of the signal A and the signal Z. At this moment, the cleaning robot may slightly turn counter-clockwise for a certain angle while continuing to move forwardly. When the two recharging sensors s1 and s2 located at the front portion of the cleaning robot both have left the coverage zone of the signal A, both sensors can only receive the signal Z, the cleaning robot may turn counter-clockwise for a certain angle, such that the two recharging sensors located at the front portion can maintain a state in which both recharging sensors can only sense the signal Z, and cannot sense the signal A and the signal B. Then, the cleaning robot may continue to move along a straight line, while maintaining the state in which the two recharging sensors located at the front portion can only detect the signal Z, until finally the cleaning robot moves to location number 5 that is close to the charging base.

It should be noted that the above example only illustratively explains how the cleaning robot searches for the recharging guidance signals transmitted by the charging base through the recharging sensors located at the front portion of the cleaning robot, and how the cleaning robot approaches the charging base under the guidance of the recharging guidance signals. The present disclosure does not limit the number and format of recharging guidance signals, and the number, format, type, and disposition locations of the recharging sensors on the cleaning robot. In actual implementations, the cleaning robot may move toward the charging base from different directions.

Figure 6B:
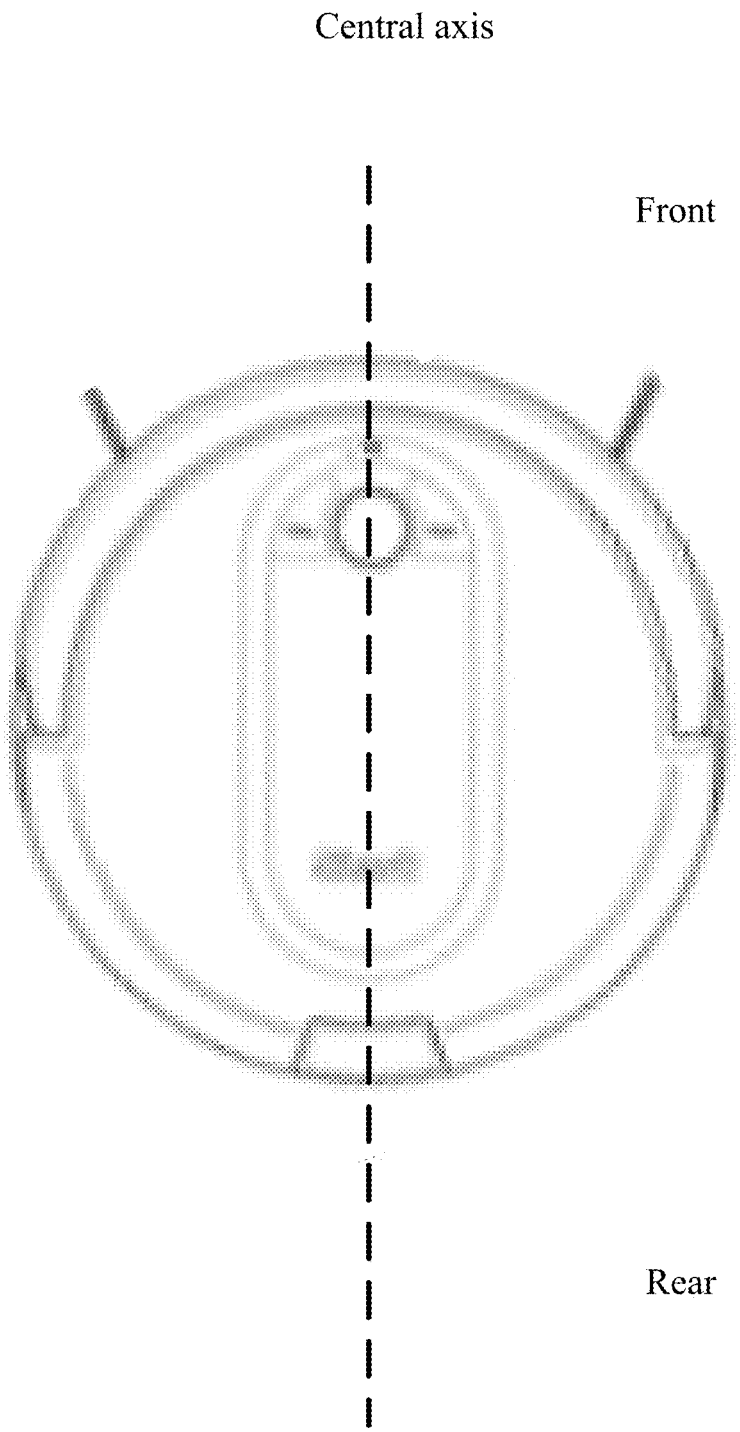

In some embodiments, the predetermined target location may be the location of the charging base. When the cleaning robot moves in a first direction and arrives at the location of the charging base (as shown in sub-figure (b) of FIG. 8), the cleaning robot may rotate for a predetermined angle. The predetermined angle may be determined based on the location of the charging base and the pose of the cleaning robot relative to the charging base. Illustratively, the predetermined angle may be determined based on an angle measured when the cleaning robot arrives at the location of the charging base, where the angle is between a central axis of the cleaning robot and a central line of the center docking zone of the charging base (also referred to as the forward direction of the charging base). In some embodiments, the rotated predetermined angle may be directly set as 180 degrees, and may not need to consider the above-mentioned measured angle. In some embodiments of the present disclosure, the above-mentioned predetermined angle for rotation may be determined based on the principle that after the cleaning robot rotates for the predetermined angle, the rear portion of the cleaning robot straightly faces the charging base (i.e., after rotating for the predetermined angle, the angle formed between the central axis of cleaning robot and the forward direction of the charging base is 180 degrees), as shown in sub-figure (c) in FIG. 8. In some embodiments, after rotating for the predetermined angle, the rear portion of the cleaning robot may not straightly face the charging base. Instead, the angle formed between the central axis of the cleaning robot and the forward direction of the charging base may be an acute angle. The central axis of the cleaning robot may be determined based on the forward moving direction of the cleaning robot (for a cleaning robot having a symmetric shape in the top view, such as a circular shape, a square shape, or a D shape, the forward moving direction (or referred to as a forward movement direction) is the axis of symmetry of the symmetric shape in the top view). For example, if the cleaning robot has a circular shape that is left-right symmetric (top view), the forward moving direction is the front direction shown in FIG. 6*b*, and the central axis is the straight line extending in the forward moving direction, as shown in FIG. 6*b*. The two ends of the central axis point to the forward moving direction and its reverse direction of the cleaning robot, respectively.

It should be noted that the cleaning robot may have other shapes such as a square shape, a polygon shape. The specific location of the central axis may be determined based on the actual shape or the forward moving direction of the cleaning robot, which is not illustrated.

S240, controlling the cleaning robot to move in the forward moving direction for a first predetermined distance.

Specifically, after the cleaning robot arrives at the charging base and rotates for a predetermined angle (i.e., the above step S230), the rear portion of the cleaning robot may face the charging base. The forward direction of the cleaning robot may be a direction that faces away from charging base. The cleaning robot may move in its forward moving direction for the first predetermined distance, moving away from the charging base, as shown in sub-figure (d) in FIG. 8.

In some embodiments, the first predetermined distance may be within a range from 40 centimeters to 60 centimeters. The first predetermined distance may be other distance values.

S250, controlling the cleaning robot to move backwardly to approach the charging base, and to dock with the charging base to perform battery charging.

In some embodiments, after the cleaning robot moves away from the charging base for the first predetermined distance, the cleaning robot may use the recharging sensors symmetrically disposed at the rear portion to detect the recharging guidance signal, thereby moving backwardly to approach the charging base. In this process, the cleaning robot has sufficient space and time to adjust its pose based on the received recharging guidance signal, such that when the cleaning robot boards the charging base, the charging plates located at the rear portion of the cleaning robot may accurately dock with a charging interface of the charging base. Typically, metal plates configured for charging may be disposed at a bottom portion of the cleaning robot. Correspondingly, the charging base may be provided with a charging interface configured to be capable of tightly contacting the charging plates. The charging interface may be metal contact points, as shown in sub-figure (e) of FIG. 8. In some embodiments, the method used for charging between the cleaning robot and the charging base may be other charging method. For example, wireless charging coils may be respectively provided on the cleaning robot and the charging base, to provide wireless charging. The present disclosure does not limit the charging method used between the cleaning robot and the charging base.

In this embodiment, because while the cleaning robot moves toward the charging base, after arriving at the target location, the cleaning robot first rotates for the predetermined angle, such that the rear portion faces the charging base, then the cleaning robot moves forwardly (i.e., moving away from the charging base) for a distance, then moves backwardly to approach the charging base, the cleaning robot has more space and time to adjust its recharging pose (direction and distance), thereby enabling the cleaning robot to accurate board the charging base to perform battery charging. This significantly reduces the chance of recharging failure caused by inaccurate boarding of the cleaning robot onto the charging base, and increases the recharging success rate.

Figure 3:
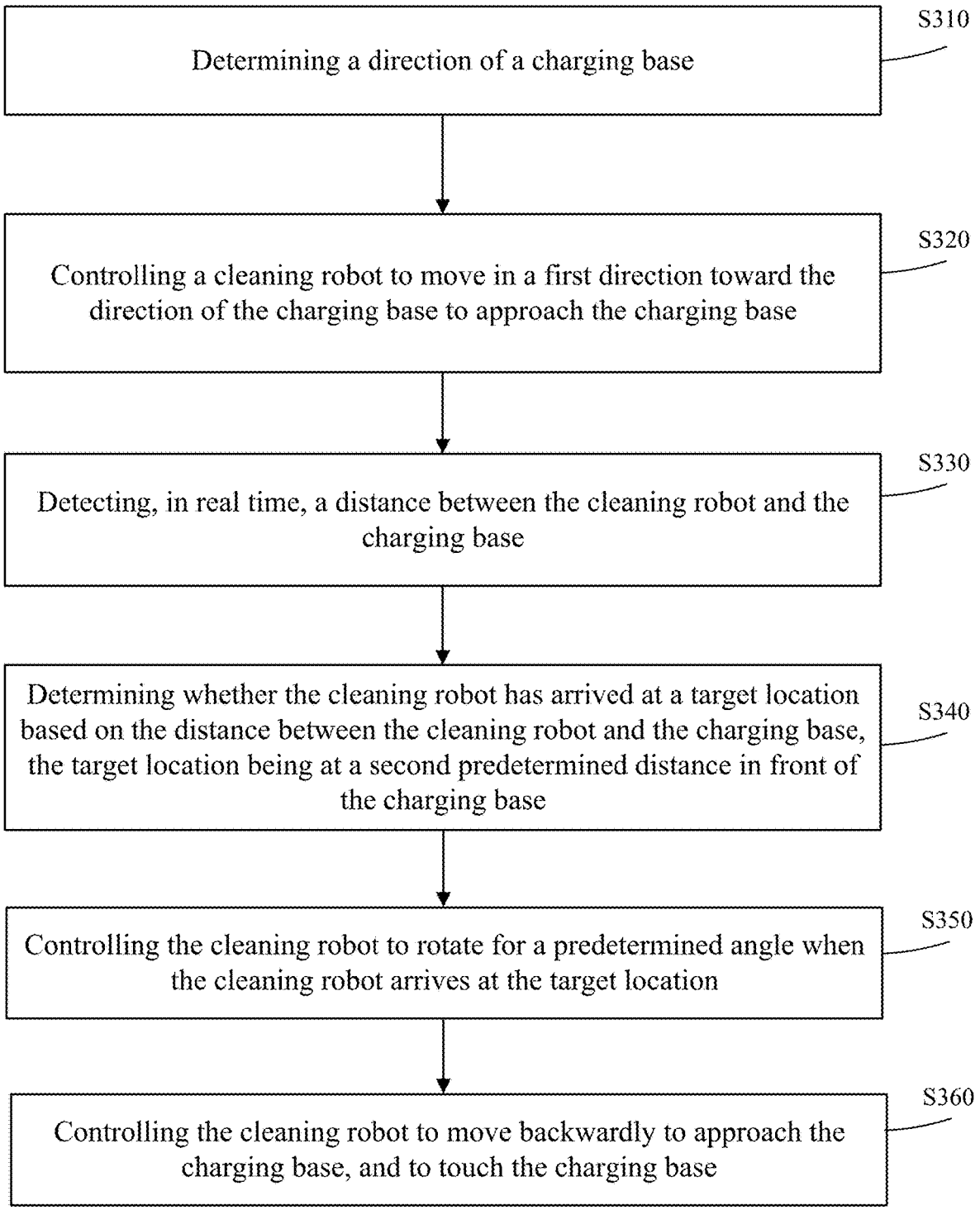
FIG. 3 is a flowchart illustrating a recharging method for a cleaning robot, according to another embodiment of the present disclosure.

FIG. 3 is a flowchart illustrating a recharging method for a cleaning robot, according to another embodiment of the present disclosure.

It should be noted that in some embodiments, the predetermined target location may be at a second predetermined distance in front of the charging base. This embodiment is based on the embodiment shown in FIG. 2. Another docking method between the cleaning robot and the charging base is explained next.

As shown in FIG. 3, the method provided by this embodiment may include the following steps.

S310, determining a direction of the charging base.

S320, controlling the cleaning robot to move in a first direction toward the direction of the charging base, to approach the charging base.

In some embodiments, the process of moving the cleaning robot in the first direction toward the direction of the charging base to approach the charging base is shown in sub-figure (a) of FIG. 9.

It should be noted that the detailed processes of the steps S310 and S320 of this embodiment can refer to the descriptions of the steps S210 and S220 of the embodiment shown in FIG. 2, which are not repeated.

S330, detecting, in real time, a distance between the cleaning robot and the charging base.

S340, determining whether the cleaning robot has arrived at a target location based on the distance between the cleaning robot and the charging base, the target location being at a second predetermined distance in front of the charging base.

In some embodiments, distance measuring sensors may be disposed at the front portion, side portions and/or top portion of the cleaning robot to measure distances between the cleaning robot and obstacles in horizontal directions in the environment. For example, a proximity sensor typically disposed on the cleaning robot may be used as a distance measuring sensor. Usually, the proximity sensor of the cleaning robot is used to indifferently detect obstacles in the environment, and does not differentiate whether the obstacle is a charging base or other type of obstacle. Therefore, if the distance measuring sensor is the proximity sensor of the cleaning robot, it may be needed to combine with the recharging guidance signal transmitted by the charging base and received by the recharging sensor of the cleaning robot, and to adjust the recharging logic, such that the charging base may be differentiated from the other type of obstacles, and the distance between the cleaning robot and the charging base may be obtained.

The distance measuring sensor or the proximity sensor may be at least one of an infrared diode, a Light Detection and Ranging sensor (LIDAR sensor) (for example, a Time of Flight (TOF) sensor or a 360° rotation laser ranging device is a type of a LIDAR sensor), or an ultrasonic distance measuring sensor.

Figure 5:
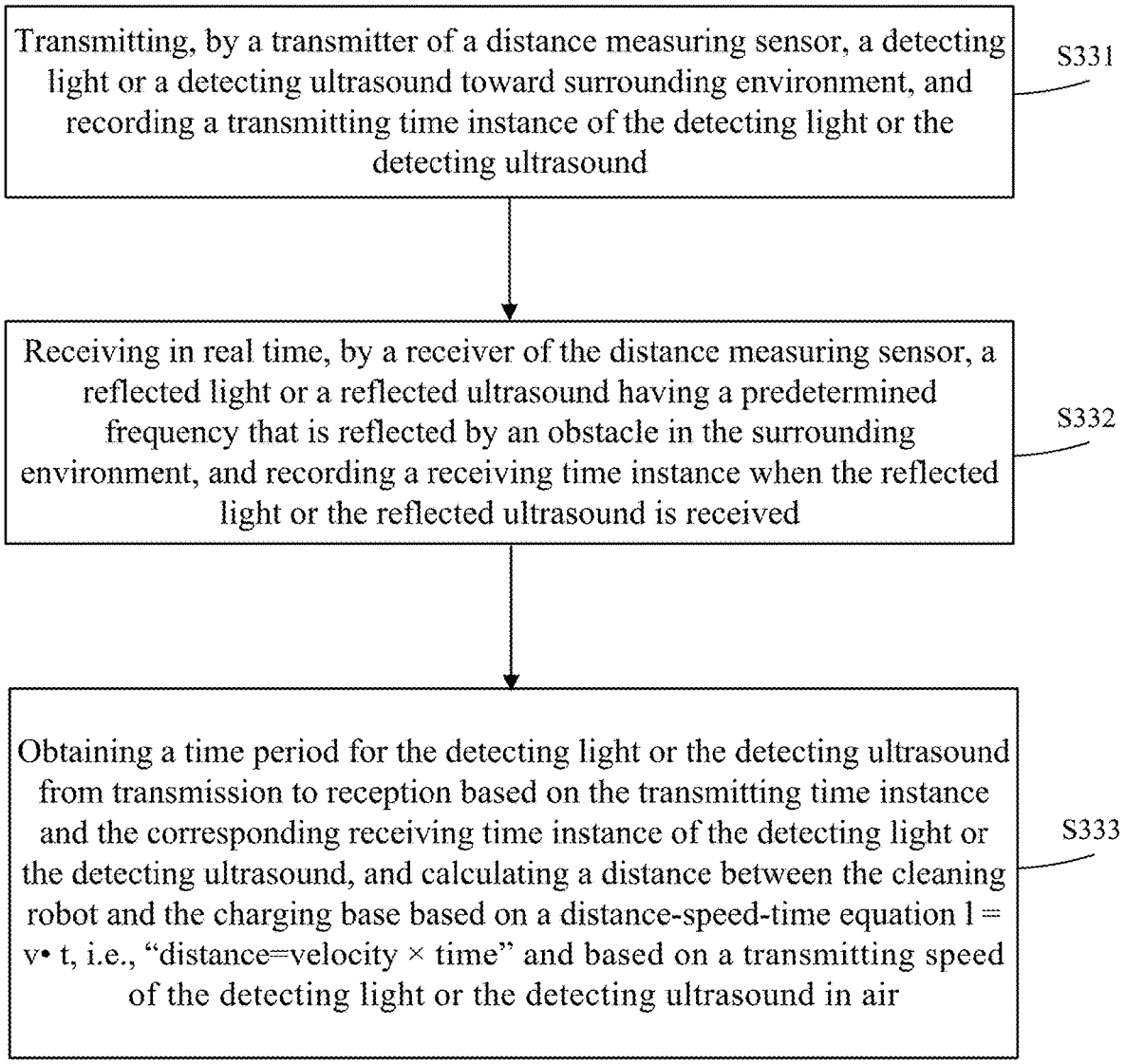
FIG. 5 is a flowchart illustrating a recharging method for a cleaning robot, according to another embodiment of the present disclosure.

When the distance measuring sensor is a TOF sensor or an ultrasonic distance measuring sensor, because both uses the equation of $l=v\cdot t$, i.e., "distance=speed×time" to calculate the distance l, the detailed measuring steps are shown in FIG. 5, which are described below:

S331, transmitting, in real time, by a transmitter of a distance measuring sensor, a detecting light or a detecting ultrasound toward surrounding environment, and recording a transmitting time instance when the detecting light or the detecting ultrasound is transmitted.

S332, receiving, by a receiver of the distance measuring sensor, a reflected light or a reflected ultrasound having a predetermined frequency, which is reflected by an obstacle in the surrounding environment, and recording a receiving time instance when the reflected light or the reflected ultrasound is received.

S333, obtaining a time period from transmission to reception of the detecting light or the detecting ultrasound based on the recorded transmitting time instance and the recorded receiving time instance of the detecting light or detecting ultrasound, and calculating a distance between the cleaning robot and the charging base based on the above distance-speed-time equation $l=v\cdot t$, i.e., "distance=speed×time," and based on a transmitting speed of the detecting medium (i.e., the detecting light or detecting ultrasound) in air.

When the distance measuring sensor or the proximity sensor is an infrared diode, its principle is different from the above method of calculating the distance based on the distance-speed-time equation. An infrared diode is a type of an opto-electric switch. An opto-electric switch detects whether there is an obstacle that blocks and reflects a detecting medium (e.g., electromagnetic wave or infrared light used for distance measurement) at a predetermined distance, thereby obtaining information indicating whether there is an obstacle at the predetermined distance. That is, when there is an obstacle at the predetermined distance, the switch is triggered. When there is no obstacle at the predetermined distance, the switch is not triggered. Therefore, what the infrared diode measures is a fixed distance (i.e., the above-described predetermined distance), and is not the variable distance measured through the above distance-speed-time equation. But the infrared diode is also a type of distance measuring sensor of the present disclosure.

In this embodiment, the above-described predetermined distance is the second predetermined distance in front of the charging base. Using the infrared diode as an example, the infrared diode includes a transmitting terminal and a receiving terminal that form a certain angle. When a light-blocking obstacle is located at the second predetermined distance from the infrared diode, the transmitting terminal and the receiving terminal of the infrared diode may be configured as: the infrared detecting light transmitted by the transmitting terminal is reflected by the obstacle when the infrared detecting light illuminates the obstacle, and the reflected light is received by the receiving terminal, such that the opto-electric switch is triggered, thereby notifying the cleaning robot that there is an obstacle (e.g., a charging base) at a location that is at the second predetermined distance from the cleaning robot. If there is no obstacle at a location that is at the second predetermined distance from the cleaning robot, the infrared detecting light transmitted by the transmitting terminal may not be reflected at the location that is at the second predetermined distance from the cleaning robot, and therefore, the receiving terminal may not receive any reflected light of the infrared detecting light transmitted by the transmitting terminal. Therefore, the switch is not triggered. As a result, the cleaning robot senses that there is no obstacle (e.g., charging base) at the location that is at the second predetermined distance from the cleaning robot.

In this embodiment, the second predetermined distance of the above-described switch type sensors (i.e., predetermined distance) may be set at as a distance between the target location and the cleaning robot. When the cleaning robot gradually approaches the charging base, the cleaning robot may determine when it arrives at the target location, i.e., the charging base.

In some embodiments, the second predetermined distance may be in a range from 20 centimeters to 60 centimeters.

In some embodiments, the target location may be a location that is about 20 to 60 centimeters right in front of the charging base. While the cleaning robot moves toward the charging base, the cleaning robot may measure the distance between the cleaning robot and the charging base through the distance measuring sensor. When the cleaning robot is in front of the charging base at a distance of 20 centimeters or 60 centimeters or any value between 20 to 60 centimeters or a specific ratio between 20 and 60 centimeters (as shown in sub-figure (b) of FIG. 9), the cleaning robot may determine that the cleaning robot has arrived at the target location. In some embodiments, the second predetermined distance may be set as other distance value or distance range.

In some embodiments, detecting, in real time, the distance between the cleaning robot and the charging base, and determining whether the cleaning robot has arrived at the target location based on the distance between the cleaning robot and the charging base, includes:

shutting down, by the cleaning robot (e.g., the controller of the cleaning robot), the transmitter of the proximity sensor, and maintaining, e.g., by the controller of the cleaning robot, an open state of the receiver of the proximity sensor; receiving, by the receiver of the proximity sensor of the cleaning robot, the first proximity signal, and determining, e.g., by the proximity sensor or the controller, whether the cleaning robot has arrived at the target location based on the first proximity signal, the first proximity signal being a proximity sensor signal transmitted by the transmitter on the charging base and receivable by the receiver of the proximity sensor of the cleaning robot; the first proximity signal being transmitted during a transmission gap between transmissions of the recharging guidance signal transmitted by the charging base; the recharging guidance signal being receivable by the recharging sensor of the cleaning robot; the first proximity signal being receivable by the receiver of the proximity sensor of the cleaning robot.

Specifically, a cleaning robot is typically provided with multiple proximity sensors. For example, two proximity sensors may be symmetrically disposed inside a housing of the cleaning robot at the front portion of the cleaning robot, and two proximity sensors may be symmetrically disposed at two sides of the cleaning robot. That may be a total of 2 groups and 4 proximity sensors. As described above, each proximity sensor may include at least a transmitter and a receiver that matches with the transmitter. When the cleaning robot enters a recharging phase, the cleaning robot may shut down (e.g., through the controller of the cleaning robot) all transmitters of the proximity sensors, or may selectively shut down a transmitter of at least one proximity sensor based on the recharging direction of the cleaning robot and the direction of the detecting light of the proximity sensor. In the meantime, the cleaning robot may maintain (e.g., through controller of the cleaning robot) an open state of the receiver of the proximity sensor, such that the first proximity signal transmitted by the charging base may be received.

A transmitter may be disposed on the charging base, and may be configured to transmit a recharging guidance signal and the first proximity signal. The transmitter of the charging base may transmit the recharging guidance signal according to a specific transmission interval. If the recharging guidance signal is transmitted as three recharging guidance signals B, Z, A as shown in FIG. 7 at different time periods, then a specific order may be followed, such as the order of signals B, Z, A or the order of signals A, B, Z, etc. A specific type of recharging guidance signal may be transmitted during every time interval Δt, then a total time period of 3 Δt may be needed to transmit a round of all three types of recharging guidance signals. In some embodiments, two or three recharging guidance signals may be simultaneously transmitted. For example, the recharging guidance signals A, B may be simultaneously transmitted during a first time interval Δt, and the recharging guidance signal Z may be transmitted during a second time interval Δt. In such a manner, the total time period of 2 Δt may be needed to transmit a round of all recharging guidance signals. As another example, three recharging guidance signals A, B, Z may be simultaneously transmitted during the first time interval Δt. In this manner, a total time period of 1×Δt may be needed for transmitting a round of all recharging guidance signals. A round of recharging guidance signals may be transmitted at every certain time interval (which is also referred to as transmitting the recharging guidance signals for one round). There may be a transmission gap ΔT between a preceding round of transmission and a subsequent round of transmission, during which time period no recharging guidance signal is transmitted. In the embodiments of the present disclosure, the first proximity signal may be transmitted during the transmission gap between transmissions of the recharging guidance signal, thereby avoiding interference between the recharging guidance signal and the first proximity signal, which in turn solves the technical issues in existing technology relating to difficulty in measuring the distance between the cleaning robot and the charging base during the recharging process. For example, as shown in FIG. 13, the recharging guidance signal may be transmitted as signals A, B, and Z. The signal A may be transmitted during a first time interval Δt, the signal Z may be transmitted during a second time interval Δt, and the signal B may be transmitted during a third time interval Δt. After that, there may be a transmission gap ΔT, in which no recharging guidance signal is transmitted. Therefore, the first proximity signal may be transmitted during the transmission gap ΔT after this round of recharging guidance signal transmission is completed. Then, the next round of recharging guidance signal transmission may be performed. As such, the cleaning robot may know, through the first proximity signal, the distance between the cleaning robot and the charging base. In addition, the interference between the recharging guidance signal and the first proximity signal may be avoided, thereby ensuring that the receiver on the cleaning robot can receive the first proximity signal to measure the distance between the cleaning robot and the charging base.

In some embodiments, determining whether the cleaning robot has arrived at the predetermined target location based on the first proximity signal may include: detecting, by the cleaning robot, whether the first proximity signal has been received, and when the first proximity signal has been received, determining that the cleaning robot has arrived at the target location; and/or detecting, by the cleaning robot, a signal strength of the received first proximity signal, and when the signal strength is greater than or equal to a predetermined signal strength threshold value, determining that the cleaning robot has arrived at the target location.

Specifically, in some embodiments, the target location may be at a second predetermined distance in front of the charging base. The value of the second predetermined distance may be in a range from 20 centimeters to 60 centimeters. After the cleaning robot rotates for a predetermined angle when arriving at the target location, the rear portion of the cleaning robot may straightly face the charging base. After the cleaning robot rotates for the predetermined angle, the distance between the rear portion and the charging base may be between 20 centimeters and 60 centimeters. As such, when the cleaning robot moves backwardly to dock with the charging base, the cleaning robot has sufficient space to adjust the pose, such that the cleaning robot can conveniently move backwardly to accurately dock with the charging base. In some embodiments, the first proximity signal may be a square wave having a peak value of 0.03 mW, a frequency of 100 Hz or 666 Hz. The first proximity signal may be detected when the distance from the cleaning robot to the charging base is within 30 cm. Therefore, when the cleaning robot detects the first proximity signal, the cleaning robot can determine that the cleaning robot has arrived at a location that is at the second predetermined distance from the charging base.

In some embodiments, the cleaning robot may have a cylindrical shape with a diameter of about 30 cm in a horizontal direction. Typically, only the front portion of the cleaning robot is provided with a proximity sensor, and the rear portion of the cleaning robot is not provided with a proximity sensor. Therefore, typically, only the front portion of the cleaning robot can receive the first proximity signal. When the proximity sensor disposed at the front portion of the cleaning robot receives the first proximity signal, the cleaning robot needs to rotate such that the rear portion accurately aims at the charging base. When the second predetermined distance is about 20 cm, considering the diametric size of the cleaning robot, after rotation, the distance between the rear portion of the cleaning robot and the charging base is about 20 cm, which leaves sufficient space for the cleaning robot to adjust its pose, such that the cleaning robot can conveniently move backwardly to contact (e.g., dock with) the charging base.

In some embodiments, the determination of whether the cleaning robot has arrived at a location that is at the second predetermined distance from the charging base may be made based on the signal strength of the first proximity signal received by the cleaning robot. Specifically, as the cleaning robot moves closer to the charging base, the detected signal strength of the first proximity signal becomes higher. If the power of the first proximity signal or the predetermined signal strength threshold value is adjusted, the range of the second predetermined distance may be changed. For example, when the peak value of the power of the first proximity signal is adjusted to 0.06 mW, while the predetermined signal strength threshold value remains unchanged, then the second predetermined distance can be 35 cm. If the power of the first proximity signal is maintained at 0.03 mW, and the predetermined signal strength threshold value is reduced to a minimum value (which may be close to the minimum value at which the proximity sensor can receive the first proximity signal), the detectable second predetermined distance is about 60 cm.

The above methods may be used simultaneously, to ensure that the cleaning robot arrives at the predetermined target location.

S350, controlling the cleaning robot to rotate for a predetermined angle when the cleaning robot arrives at the target location.

In some embodiments, the predetermined target location may be 20 to 60 centimeters away from the charging base. When the cleaning robot arrives at the target location (as shown in sub-figure (b) of FIG. 9), the cleaning robot may rotate for a predetermined angle. The predetermined angle may be determined based on the location of the charging base and the pose of the cleaning robot relative to the charging base. Illustratively, the predetermined angle may be determined based on an angle measured when the cleaning robot arrives at the location of the charging base, where the angle is between the central axis of the cleaning robot and a center line of a center docking zone of the charging base (also referred to as the forward direction of the charging base). In some embodiments, the rotated predetermined angle may be directly set as 180 degrees, and may not need to consider the measured angle. In some embodiments of the present disclosure, the above-mentioned predetermined angle for rotation may be determined based on the principle that after the cleaning robot rotates for the predetermined angle, the rear portion of the cleaning robot straightly faces the charging base (i.e., after rotating for the predetermined angle, the angle formed between the central axis of cleaning robot and the forward direction of the charging base is 180 degrees), as shown in sub-figure (c) in FIG. 9. In some embodiments, after rotating for the predetermined angle, the rear portion of the cleaning robot may not straightly face the charging base. Instead, the angle formed between the central axis of the cleaning robot and the forward direction of the charging base may be an acute angle, such that the rear portion of the cleaning robot accurately aims at the charging base.

S360, controlling the cleaning robot to move backwardly to approach the charging base, and to touch the charging base.

Specifically, in some embodiments, when the cleaning robot arrives at the target location, the cleaning robot is away from the charging base at a certain distance (i.e., the second predetermined distance). Therefore, after the cleaning robot rotates at the target location, the cleaning robot may move backwardly to approach the charging base, thereby touching the charging base, as shown in sub-figure (d) of FIG. 9.

In this embodiment, because the target location where the cleaning robot rotates is at a second predetermined distance (e.g., 20 to 60 centimeters) in front of the charging base, after the rotation, the cleaning robot may directly move backwardly to board the charging base. If at this moment the charging plates of the cleaning robot happen to accurately aim at the charging interface of the charging base, the boarding time of the cleaning robot may be saved. However, under some circumstances, even if the charging plates of the cleaning robot can dock with the charging points of the charging base, because of the unstable docking, or some errors in the docking angle, the charging plates and the charging points may automatically separate from one another during the battery charging process, causing the battery charging to be incomplete. To avoid such issues, and to be safe, the following steps are often added to realize more stable contact and charging between the charging plates of the cleaning robot and the charging points of the charging base.

Figure 4:
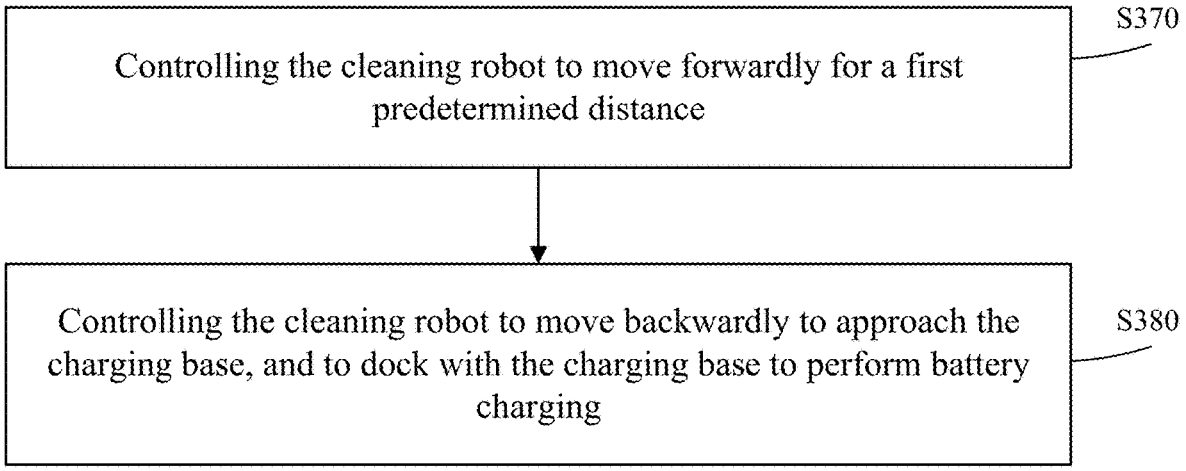
FIG. 4 is a flowchart illustrating a recharging method for a cleaning robot, according to another embodiment of the present disclosure.

In some embodiments, referring to FIG. 4, the recharging method for the cleaning robot may include the following steps after the steps shown in FIG. 3.

S370, controlling the cleaning robot to move in a forward direction for a first predetermined distance.

In some embodiments, as shown in sub-figure (e) of FIG. 9, after the cleaning robot touches the charging base, and before docking with the charging base, the cleaning robot may move forwardly away from the charging base for the first predetermined distance. In some embodiments, the range for the first predetermined distance may be 40 centimeters to 60 centimeters. For example, the first predetermined distance may be 50 centimeters. There may be two situations for implementing this step. A first situation is, after step S360, regardless of whether the cleaning robot successfully docks with the charging base, step S370 is directly executed. A second situation is, the cleaning robot executes step S370 only when the cleaning robot does not successfully dock with the charging base after the cleaning robot executes step S360. The difference between the two situations is, in the first situation, there is no need to determine whether the cleaning robot and the charging base dock successfully, i.e., there is no need to determine whether the charging plates disposed at the rear portion of the cleaning robot respectively contact the charging points of the charging base. In the second situation, there is a need to determine whether the cleaning robot and the charging base dock successfully. The technical solutions of the present disclosure focus on the first situation.

S380, controlling the cleaning robot to move backwardly to approach the charging base, and to dock with the charging base to perform battery charging.

In some embodiments, following step S370, after the cleaning robot arrives at a location that is at the first predetermined distance from the charging base, the cleaning robot may move backwardly to approach the charging base. Because in this process the cleaning robot generally moves straightly forwardly and moves straightly backwardly, an issue relating to uncontrollable stability of the docking between the charging plates of the cleaning robot and the charging points of the charging base caused by small error in the docking angle when the cleaning robot boards the charging base can be effectively avoided, thereby realizing accurate docking between the charging plates disposed at the rear portion of the cleaning robot and the charging interface of the charging base (e.g., two charging points on the charging base), as shown in sub-figure (f) of FIG. 9.

In this embodiment, first, the cleaning robot touches the charging base (but not docking with the charging base), and then moves forwardly away from the charging base, and finally moves backwardly again to board the charging base (i.e., to dock with the charging base). This process enables the cleaning robot to have sufficient time and space to adjust the pose when boarding the charging base, such that the docking with the charging base can be more accurate, thereby reducing the possibility of recharging failure.

In some embodiments, the recharging method for the cleaning robot may also include: during the process of the cleaning robot moving backwardly to approach the charging base, the cleaning robot may adjust a motion pose based on the recharging guidance signal transmitted by the charging base, such that the backward movement direction of the cleaning robot is basically inside the center docking zone in front of the charging base, thereby enabling the charging plates disposed at the rear portion of the cleaning robot to more easily and accurately aim at the charging points on the charging base, which increases the success rate of the cleaning robot boarding the charging base. In this process, at some time instance during the recharging process, the cleaning robot may move out of the center docking zone of the charging base, but the cleaning robot may still return to the center docking zone of the charging base under the guidance of the recharging guidance signal. The detailed manner in which the recharging guidance signal guides the cleaning robot to enter the center docking zone of the charging base is described above, which is not repeated here.

Specifically, referring to FIG. 10, multiple recharging sensors symmetrically disposed at the rear portion of the cleaning robot may detect the recharging guidance signal transmitted by the charging base. In the process of guiding the cleaning robot to move backwardly to approach the charging base, the cleaning robot may not move right in front of the charging base, but may be approaching the charging base starting from a side (e.g., the location D shown in FIG. 10). When the cleaning robot enters the coverage zone of the recharging guidance signal transmitted by the charging base, the cleaning robot may adjust the movement pose based on the recharging guidance signal, such that the cleaning robot gradually moves to the center docking zone of the charging base (e.g., the location E shown in FIG. 10). Then, the cleaning robot may continue adjusting a motion pose based on the recharging guidance signal, such that the moving direction of the cleaning robot stays within the center docking zone as much as possible. As shown in FIG. 11, the moving direction of the cleaning robot after the pose adjustment is generally within the center docking zone of the charging base, and the cleaning robot may approach the charging base.

It should be noted, that in this embodiment, the principle of adjusting a motion pose of the cleaning robot, such that the moving direction of the cleaning robot accurately aims at the center docking zone located right in front of the charging base can refer to the descriptions of the related embodiments corresponding to FIG. 7, which are not repeated.

It should be noted that, the same or similar portions of the above embodiments can refer to one another. Content of some embodiments that have not been described in detail can refer to the same or similar content of other embodiments.

In an illustrative embodiment of the present disclosure, a cleaning robot system is provided, which may include the charging base 101 and the cleaning robot 102 shown in FIG. 1. As shown in FIG. 19, the cleaning robot 102 may include:

- a determination device 1021 configured to determine a direction of the charging base;
- a motion device 1022 configured to move the cleaning robot; the movement may be moving forward, moving backward, spinning, and various combinations of the above movements. The movement may be moving at a constant speed, moving at a variable speed (including acceleration, deceleration), or moving alternately with any combination of acceleration, deceleration, and/or moving at a constant speed. The present disclosure does not limit the specific format of movement. The motion device may include various motion components, such as a multi-legged motion system, a wheel group, a track, etc. The present disclosure does not limit the specific format of the motion device.

The cleaning robot 102 may also include a controller 1023 configured to control the cleaning robot to move in a first direction toward the direction of the charging base, to approach the charging base.

In some embodiments, the controller may also be configured to control the cleaning robot to rotate for a predetermined angle when the cleaning robot arrives at a predetermined target location.

In some embodiments, the controller may also be configured to control the cleaning robot to move forwardly for a predetermined distance.

In some embodiments, the controller may also be configured to control the cleaning robot to move backwardly to approach the charging base, and to dock with the charging base to perform battery charging.

Further, in some embodiments, the target location may be at a second predetermined distance in front of the charging base. The cleaning robot may include a detection device (e.g., a proximity sensor or a 360° rotation laser ranging device). The detection device may be configured to detect, in real time, a distance between the cleaning robot and the charging base after the determination device determines the direction of the charging base. The controller may be specifically configured to determine whether the cleaning robot has arrived at the target location based on the distance between the cleaning robot and the charging base. In some embodiments, before the cleaning robot moves forwardly for the first predetermined distance, the controller may be specifically configured to: control the cleaning robot to move backwardly to approach the charging base, and to touch the charging base.

Further, in some embodiments, the target location may be the location of the charging base.

Further, in some embodiments, the controller may be specifically configured to: while the cleaning robot moves toward the charging base, adjust a motion pose based on the recharging guidance signal transmitted by the charging base, such that the moving direction of the cleaning robot accurately aims at the center docking zone located right in front of the charging base.

Detailed descriptions of the functions of the various devices, components, or units of this embodiment can refer to the descriptions of related method embodiments, which are not repeated.

FIG. 12 is a flowchart illustrating a recharging method of a cleaning robot, according to another illustrative embodiment of the present disclosure.

As shown in FIG. 12, the method of this embodiment may include the following steps.

S121, transmitting, by a transmitter on the charging base, a recharging guidance signal and a first proximity signal, the first proximity signal being transmitted during a transmission gap between transmissions of the recharging guidance signal, the recharging guidance signal being receivable by a recharging sensor of the cleaning robot, the first proximity signal being receivable by a receiver of a proximity sensor of the cleaning robot.

The charging base may use the same transmitter to transmit the recharging guidance signal and the first proximity signal, or may use different transmitters to respectively transmit the recharging guidance signal and the first proximity signal, which is not limited by the present disclosure.

In some embodiments, the recharging guidance signal may be a high-frequency carrier wave encoding signal having a peak value of about 0.03 mW. The carrier wave may be a square wave. The first proximity signal may be a low-frequency (e.g., 100 Hz or 600 Hz) square wave having a peak value of about 0.03 mW. The transmitter on the charging base may transmit the recharging guidance signal according to a predetermined transmission interval, that is, a round of the recharging guidance signal may be transmitted at every specific time interval. There may be a transmission gap Δ T between a preceding round and a subsequent round of transmissions of the recharging guidance signal, during which period no recharging guidance signal is transmitted. The first proximity signal may be transmitted during the transmission gap between transmissions of the recharging guidance signal, thereby avoiding interference between the recharging guidance signal and the first proximity signal. Thus, the technical issues in existing technology relating to the difficulty in measuring the distance between the cleaning robot and the charging base during the recharging process can be resolved.

Illustratively, as shown in FIG. 13, the recharging guidance signals may include signals A, B, and Z. Signal A may be transmitted during a first time interval Δt, signal Z may be transmitted during a second time interval Δt, and signal B may be transmitted during a third time interval Δt. Then, there may be a transmission gap ΔT during which period no recharging guidance signal is transmitted. Therefore, the first proximity signal may be transmitted during the transmission gap ΔT following this round of transmission of the recharging guidance signals. Then, a next round of recharging guidance signals may be transmitted. As such, the cleaning robot may know the distance between the cleaning robot and the charging base through this first proximity signal. In addition, interference between the recharging guidance signal and the first proximity signal may be avoided, thereby ensuring that the receiver on the cleaning robot may measure the distance between the cleaning robot and the charging base by receiving the first proximity signal.

S122, when the cleaning robot enters a recharging phase, shutting down, by the cleaning robot, a transmitter of a proximity sensor, and maintaining an open state of a receiver of the proximity sensor.

In some embodiments, a triggering condition for triggering the recharging method of the embodiments of the present disclosure, i.e. a condition for determining whether the cleaning robot needs to perform a recharging process, may include the following two categories: one category is determining whether a recharging process is needed based on the electric power. For example, when the remaining electric power of the cleaning robot is lower than a predetermined electric power threshold value (e.g., 20%), the cleaning robot may automatically search for the charging base to perform battery charging. Another category is determining whether the cleaning robot needs to perform the recharging process based on other determining conditions. For example, the determination may be made based on an area covered by the movement of the cleaning robot. For example, when the area covered by the movement of the cleaning robot is greater than a predetermined area threshold value (e.g., greater than 100 square meters), the cleaning robot may automatically perform a recharging process. As another example, the determination may be made based on an operation time of the cleaning robot. When the operation time is greater than a predetermined time threshold value (e.g., 3 hours), the cleaning robot may automatically perform a recharging process. Regardless of which determination condition is used, when the determination condition is satisfied, the cleaning robot may automatically switch to performing the recharging method of the embodiments of the present disclosure.

Specifically, a cleaning robot is typically provided with multiple proximity sensors. For example, two proximity sensors may be symmetrically disposed inside a housing of the cleaning robot at the front portion of the cleaning robot, and two proximity sensors may be symmetrically disposed at two sides of the cleaning robot. That is a total of 2 groups and 4 proximity sensors. As described above, each proximity sensor may include at least a transmitter and a receiver that matches with the transmitter. When the cleaning robot enters a recharging phase, the cleaning robot (e.g., a controller of the cleaning robot) may shut down all transmitters of the proximity sensors, or may selectively shut down a transmitter of at least one proximity sensor based on the recharging direction of the cleaning robot and the direction of the detecting light of the proximity sensor. In the meantime, the cleaning robot (e.g., the controller) may maintain the open state of the receiver of the proximity sensor, such that the first proximity signal transmitted by the charging base may be received.

S123, receiving, by a receiver of a proximity sensor of the cleaning robot, the first proximity signal, and detecting, by the proximity sensor, a distance between the cleaning robot and the charging base based on the first proximity signal.

In some embodiments, detecting a distance between the cleaning robot and the charging base based on the first proximity signal, includes: detecting, by the cleaning robot, whether the receiver of the proximity sensor receives the first proximity signal; when the first proximity signal is detected, determining that the cleaning robot has moved to a location that is away from the charging base at a second predetermined distance; and/or, detecting, by the cleaning robot, a signal strength of the received first proximity signal, and when the signal strength is greater than or equal to a predetermined signal strength threshold value, determining that the cleaning robot has moved to a location that is at a second predetermined distance from the charging base.

Specifically, in some embodiments, the second predetermined distance may be within a range of 20 centimeters to 60 centimeters. The first proximity signal may be a square wave having a peak value of the about 0.03 mW, a frequency of 100 Hz or 666 Hz. The cleaning robot may detect the first proximity signal within a range of about 30 cm from the charging base. As such, when the cleaning robot detects the first proximity signal, the cleaning robot may determine that the cleaning robot has arrived at a location that is at the second predetermined distance from the charging base.

In some embodiments, the cleaning robot may have a cylindrical shape with a diameter of about 30 cm in the horizontal direction. Typically, only the front portion of the cleaning robot is provided with a proximity sensor, and the rear portion of the cleaning robot is not provided with a proximity sensor. Therefore, typically, only the front portion of the cleaning robot can receive the first proximity signal. When the proximity sensor disposed at the front portion of the cleaning robot receives the first proximity signal, the cleaning robot needs to rotate such that the rear portion accurately aims at the charging base. When the second predetermined distance is about 20 cm, considering the diametric size of the cleaning robot, after rotation, the distance between the rear portion of the cleaning robot and the charging base is about 20 cm, which leaves sufficient space for the cleaning robot to adjust its pose, such that the cleaning robot can conveniently move backwardly to contact the charging base.

In some embodiments, the determination of whether the cleaning robot has moved to the location that is at the second predetermined distance from the charging base may be made based on the signal strength of the first proximity signal received by the cleaning robot. Specifically, as the cleaning robot moves closer to the charging base, the detected signal strength of the first proximity signal becomes higher. If the power of the first proximity signal or predetermined signal strength threshold value is adjusted, the range of the second predetermined distance may be changed. For example, when the peak value of the power of the first proximity signal is adjusted to 0.06 mW, while the predetermined signal strength threshold value remains unchanged, then the second predetermined distance may be 35 cm. If the power of the first proximity signal is maintained at 0.03 mW, and the predetermined signal strength threshold value is reduced to a minimum value (which may be close to the minimum value at which the proximity sensor can receive the first proximity signal), the detectable second predetermined distance is about 60 cm.

The above methods may be used simultaneously, to ensure that the cleaning robot arrives at the predetermined target location.

S124, controlling the cleaning robot to approach the charging base based on the distance between the cleaning robot and the charging base, and to dock with the charging base to perform battery charging.

Specifically, when the cleaning robot is away from the charging base at the second predetermined distance, the cleaning robot may approach the charging base and perform battery charging using the charging base. In addition, while the cleaning robot approaches the charging base, the recharging sensor on the cleaning robot may search for and receive the recharging guidance signal transmitted by the charging base, adjust a pose of itself under the guidance of the recharging guidance signal while approaching the charging base, and accurately dock with the charging base to perform the battery charging.

In this embodiment, the recharging sensor mounted on the cleaning robot may be an infrared encoder or an infrared receiver module (IRM).

In some embodiments, referring to FIG. 14, detecting the distance between the cleaning robot and the charging base based on the first proximity signal in step S123 of the above embodiment, may be specifically implemented to include the following steps:

S1231, when the cleaning robot receives the first proximity signal, starting a transmitter of a proximity sensor, and transmitting, by the transmitter of the proximity sensor, a second proximity signal toward the charging base.

In this step, the first proximity signal and the second proximity signal may both be infrared signals, or ultrasound signals.

S1232, reflecting, by a reflector on the charging base, the second proximity signal back to the cleaning robot;

S1233, determining, by the cleaning robot, the distance between the cleaning robot and the charging base based on the second proximity signal. In some embodiments, the proximity sensor on the cleaning robot may determine the distance. In some embodiments, the controller on the cleaning robot may determine the distance based on data received from the proximity sensor that receives the second proximity signal.

Specifically, when the cleaning robot transmits the second proximity signal, the cleaning robot records a transmitting time instance of the second proximity signal. When the cleaning robot receives the second proximity signal reflected back by the charging base, the cleaning robot records a receiving time instance of the second proximity signal. The transmitting time instance of the second proximity signal is a time instance when the cleaning robot transmits the second proximity signal. The receiving time instance of the second proximity signal is a time instance when the cleaning robot receives the second proximity signal reflected back by the charging base. Then, the cleaning robot may determine the distance between the cleaning robot and the charging base based on the transmitting time instance of the second proximity signal, the receiving time instance of the second proximity signal, and a transmitting speed of the second proximity signal.

In order to differentiate the second proximity signal reflected back by the charging base and the second proximity signal reflected back by other obstacles, and to avoid the interference by the signal reflected back by the obstacles, a direction of the charging base may be determined based on the recharging guidance signal, and an angle of the receiver may be configured, such that it becomes easier for the receiver to receive the second proximity signal reflected back by the charging base. As such, the signal strength of the second proximity signal reflected back by the charging base is greater than the signal strength of the second proximity signal reflected back by obstacles in other directions. During the signal processing, a receiving time instance corresponding to the maximum signal strength of the second proximity signal may be selected as the receiving time instance of the second proximity signal for calculating the distance between the charging base and the cleaning robot. In some embodiments, other methods may be used to determine the second proximity signal reflected back by the charging base. For example, the reflector may be made by a material having a stronger or weaker reflectance of the second proximity signal, such that the second proximity signal reflected by the reflector can be clearly differentiated from the second proximity signal reflected by other obstacles.

Specifically, the distance between the cleaning robot and the charging base=(receiving time instance of the second proximity signal−transmitting time instance of the second proximity signal)/(transmitting speed of the second proximity signal).

In this embodiment, the first proximity signal receivable by the receiver of the proximity sensor of the cleaning robot may be transmitted by the charging base during a transmission gap ΔT between transmissions of the recharging guidance signal. In addition, the second proximity signal may be transmitted by the cleaning robot toward the charging base when receiving the first proximity signal. The distance between the cleaning robot and the charging base may be calculated based on the second proximity signal reflected back by the charging base.

When the second proximity signal is an electromagnetic wave (e.g., an infrared), because the speed of the light is about $3\times10^8$ m/s, using the speed of the light to measure a distance at a centimeter level, a timer needs to reach $10^{-10}$ s, i.e., 0.1 ns level. Therefore, on the cleaning robot, typically a high-accuracy timer is disposed to record the transmitting time instance and the receiving time instance of the second proximity signal. In some embodiments, the timer may be integrated in the receiver of the proximity sensor on the cleaning robot, or be integrated in the proximity sensor as a separate component from the receiver, or may be a separate component from the proximity sensor.

It should be noted that the present disclosure does not limit the specific method of calculating the distance between the cleaning robot and the charging base to be using the distance-speed-time equation. Other methods may also be used. For example, a high-accuracy timer may be mounted on the charging base. The starting time and the ending time of the proximity signal may be detected by the charging base. The distance between the cleaning robot and the charging base may be calculated by the charging base, and the distance may be transmitted to the cleaning robot. In some embodiments, high-accuracy timers may be mounted on both the cleaning robot and the charging base. Multiple light transmitting time periods or distances may be respectively calculated based on the distance-speed-time equation. Then an average value may be obtained as the distance between the cleaning robot and the charging base.

FIG. 15 is a schematic illustration of a structure of the cleaning robot, according to an illustrative embodiment of the present disclosure.

As shown in FIG. 15, the cleaning robot provided in this embodiment includes: one or more recharging sensors 151 and one or more proximity sensors 152; wherein, each recharging sensor 151 may be configured to receive the recharging guidance signal transmitted by the charging base;

each proximity sensor 152 may be configured to detect obstacles in surrounding environment of the cleaning robot in a contactless manner, each proximity sensor 152 including a transmitter and a receiver; wherein, when the cleaning robot enters a recharging phase, the cleaning robot may shut down the transmitter of the proximity sensor 152, and maintain an open state of the receiver of the proximity sensor 152;

the receiver of the proximity sensor 152 of the cleaning robot may receive the first proximity signal, and detect the distance between the cleaning robot and the charging base in real time based on the first proximity signal;

The cleaning robot may approach the charging base based on the distance between the cleaning robot and the charging base, and dock with the charging base to perform battery charging.

A cleaning robot is typically provided with multiple proximity sensors 152. For example, two proximity sensors may be symmetrically disposed inside a housing of the cleaning robot at the front portion of the cleaning robot, and two proximity sensors may be symmetrically disposed at two sides of the cleaning robot. That is a total of 2 groups and 4 proximity sensors 152, as shown in FIG. 15. The cleaning robot may shut down all transmitters of the proximity sensors, or may selectively shut down a transmitter of at least one proximity sensor based on the recharging direction of the cleaning robot and the direction of the detecting light of the proximity sensor. A cleaning robot typically includes multiple recharging sensors 151. As shown in FIG. 15, two recharging sensors 151 that can receive the recharging guidance signal may be symmetrically disposed at the front portion and rear portion of the cleaning robot, respectively, to receive a total of four recharging guidance signals. The recharging sensors may be, for example, infrared sensors configured to receive recharging guidance signals such as high-frequency (e.g., 38 KHz) carrier wave encoding signals, where the carrier wave may be a square wave. The recharging sensors may respectively search for and receive the recharging guidance signals at the front portion (e.g., in steps S220, S320, S340) and the rear portion (e.g., in steps S250, S360, S380) of the cleaning robot.

Specifically, the transmitter on the charging base may transmit the recharging guidance signal, and may transmit the first proximity signal during the transmission gap ΔT between transmissions of the recharging guidance signal, thereby avoiding interference between the recharging guidance signal and the first proximity signal, which in turn solves the technical issues in existing technology relating to difficulty in measuring the distance between the cleaning robot and the charging base during the recharging process. Detailed descriptions can refer to FIG. 13 and the descriptions of the embodiment shown in FIG. 13, which are not repeated.

Further, in some embodiments, after the cleaning robot receives the first proximity signal transmitted by the charging base, the cleaning robot determines that the distance between the cleaning robot and the charging base or starts measuring the distance between the cleaning robot and the charging base. Specifically, when the receiver of the proximity sensor of the cleaning robot receives the first proximity signal, the cleaning robot (e.g., the controller of the cleaning robot) may start the transmitter of the proximity sensor, and the transmitter of the proximity sensor may transmit the second proximity signal toward the charging base. The cleaning robot (e.g., the controller of the cleaning robot) may record the transmitting time instance of the second proximity signal. The reflector on the charging base may reflect the second proximity signal. The cleaning robot (e.g., the proximity sensor on the cleaning robot) may receive the second proximity signal reflected back by the charging base, and may record (e.g., through the controller of the cleaning robot) the receiving time when the reflected second proximity signal is received. The distance between the cleaning robot and the charging base may be determined based on the transmitting time instance of the second proximity signal, the receiving time instance of the second proximity signal, and a transmitting speed of the second proximity signal.

Specifically, the distance between the cleaning robot and the charging base=(the receiving time instance of the second proximity signal−the transmitting time instance of the second proximity signal)/(the transmitting speed of the second proximity signal).

FIG. 16 is a schematic illustration of a structure of the charging base 101 according to an illustrative embodiment of the present disclosure.

As shown in FIG. 16, the charging base 101 of this embodiment includes: a transmitter 161.

The transmitter 161 may transmit the recharging guidance signal and the first proximity signal, and the first proximity signal may be transmitted during a transmission gap between transmissions of the recharging guidance signal. The first proximity signal may be receivable by the receiver of the proximity sensor of the cleaning robot. The recharging guidance signal may be receivable by the recharging sensor of the cleaning robot. The recharging guidance signal transmitted by the transmitter 161 may guide the cleaning robot to board the charging base 101. The first proximity signal transmitted during the transmission gap ΔT between transmissions of the recharging guidance signal may enable the cleaning robot to calculate the distance between the cleaning robot and the charging base 101, thereby enabling the cleaning robot to more accurately board the charging base 101.

Further, in an embodiment, the charging base 101 may also include a reflector 162.

The reflector 162 may be configured to reflect the second proximity signal transmitted by the transmitter of the proximity sensor of the cleaning robot.

Specifically, the transmitter on the charging base may transmit the recharging guidance signal, and may transmit the first proximity signal during the transmission gap ΔT between transmissions of the recharging guidance signal, thereby avoiding interference between the recharging guidance signal and the first proximity signal, which in turn solves the technical issues in existing technology relating to difficulty in measuring the distance between the cleaning robot and the charging base during the recharging process. Detailed descriptions can refer to FIG. 13 and the descriptions of the embodiment shown in FIG. 13, which are not repeated.

Further, after the cleaning robot receives the first proximity signal transmitted by the charging base, the cleaning robot may start measuring the distance between the cleaning robot and the charging base. Specifically, when the receiver of the proximity sensor of the cleaning robot receives the first proximity signal, the cleaning robot may start the transmitter of the proximity sensor. The transmitter of the proximity sensor may transmit the second proximity signal toward the charging base. The transmitting time instance of the second proximity signal may be recorded by the cleaning robot. The reflector on the charging base reflects the second proximity signal. The cleaning robot receives the second proximity signal reflected back by the charging base, and records the receiving time instance when the reflected second proximity signal is received. The distance between the cleaning robot and the charging base may be determined based on the transmitting time instance of the second proximity signal, the receiving time instance of the second proximity signal, and the transmitting speed of the second proximity signal. The detailed determination method may refer to the descriptions of the above embodiments, which is not repeated.

FIG. 17 is a schematic illustration of a structure of a cleaning robot system according to an illustrative embodiment of the present disclosure.

As shown in FIG. 17, the system of this embodiment may include: a cleaning robot 171 and a charging base 172. The charging base 172 may be the same as the charging base 101 shown in other figures. The cleaning robot 171 may be the same as the cleaning robot 102 shown in other figures.

The charging base may be provided with the transmitter 161 configured to transmit the recharging guidance signal and the first proximity signal. The first proximity signal may be transmitted during the transmission gap ΔT between transmissions of the recharging guidance signal. The recharging guidance signal may be received by the recharging sensor 151 of the cleaning robot. The first proximity signal may be received by the receiver of the proximity sensor 152 of the cleaning robot.

The receiver of the proximity sensor 152 of the cleaning robot may receive the first proximity signal, and detect the distance between the cleaning robot and the charging base based on the first proximity signal; the cleaning robot may approach the charging base based on the distance between the cleaning robot and the charging base, and may dock with the charging base to perform battery charging; wherein, when the cleaning robot enters the recharging phase, the cleaning robot may shut down the transmitter of the proximity sensor, and maintain an open state of the receiver of the proximity sensor.

FIG. 18 is a schematic illustration of a hardware structure of a cleaning apparatus 180 according to an embodiment of the present disclosure. As shown in FIG. 18, the cleaning apparatus 180 of this embodiment may include: at least one processor 1801 and a storage device 1802. The processor 1801 and the storage device 1802 may be connected through a bus 1803. The processor 1801 may also be referred to as a controller (e.g., the controller 1023), or may be part of a controller. The processor 1801 may handle various control and information/data processing of the cleaning robot. The cleaning apparatus 180 may be a as part of the cleaning robot (e.g., cleaning robot 102), or may be the cleaning robot 102.

In some implementations, the at least one processor 1801 may execute computer-executable instructions stored in the storage device 1802, such that the at least one processor 1801 may perform the recharging method of the cleaning robot according to the above embodiments.

In some embodiments, an electronic device may be a terminal, such as a cell phone, a computer, etc.

The detailed implementations of the processor 1801 may refer to the above described embodiments, which share similar implementation principles and technical effects, and hence are not repeated here.

In the embodiment shown in FIG. 18, it should be understood, that the processor may be a Central Processing Unit (CPU), or another general processor, a Digital Signal Processor (DSP), an Application Specific Integrated Circuit (ASIC), etc. The general processor may be a micro-processor or any other regular processor. The steps of the above described methods may be executed by the hardware processor, or may be executed by a combination of hardware and/or software modules in the processor.

The storage device may include a high-speed Random Access Memory (RAM) storage device, or may include a Non-Volatile Memory (NVM).

The bus may be an Industry Standard Architecture (ISA) bus, a Peripheral Component Interconnect (PCI) bus, or an Extended Industry Standard Architecture (EISA) bus, etc. The bus may be an address bus, a data bus, a control bus, etc. For convenience of descriptions, the bus in the accompanying drawings is not limited to being a single bus or a specific type of bus.

Another embodiment of the present disclosure provides a computer-readable storage medium. The computer-readable storage medium may store computer-executable instructions. When the processor executes the computer-executable instructions, the recharging method of the cleaning robot according to the above embodiments may be performed.

The computer-readable storage medium may be realized using a volatile or non-volatile storage device of any type or a combination thereof, such as a static random-access memory (SRAM), an electrically erasable programmable read-only memory (EEPROM), an erasable programmable read-only memory (EPROM), a programmable read-only memory (PROM), a read-only memory (ROM), a magnetic storage device, a flash drive, a magnetic disk or an optic disk. The computer-readable storage medium may be any suitable medium that may store data to be retrieved by a general purpose or specifically configured computer.

An illustrative storage medium may be coupled with the processor, such that the processor may retrieve information or data from the computer-readable storage medium, and may write information into the computer-readable storage medium. In some embodiments, the computer-readable storage medium may be part of the processor. The processor and the computer-readable storage medium may be located on an Application Specific Integrated Circuit (ASIC). In some embodiments, the processor and the computer-readable storage medium may be separate components in a device.

In some embodiments, the present disclosure provides a recharging method for a cleaning robot. The recharging method may include transmitting, by a transmitter on a charging base, a recharging guidance signal and a first proximity signal, wherein the first proximity signal is transmitted during a transmission gap between transmissions of the recharging guidance signal, the recharging guidance signal is receivable by a recharging sensor of the cleaning robot, and the first proximity signal is receivable by a receiver of a proximity sensor of the cleaning robot. The recharging method may also include, when the cleaning robot enters a recharging phase, shutting down, by the cleaning robot, a transmitter of the proximity sensor, and maintaining an open state of the receiver of the proximity sensor. The recharging method may also include receiving, by the receiver of the proximity sensor of the cleaning robot, the first proximity signal, and detecting a distance between the cleaning robot and the charging base based on the first proximity signal. The recharging method may also include controlling, by a controller of the cleaning robot, the cleaning robot to approach the charging base based on the distance between the cleaning robot and the charging base, and to dock with the charging base to perform battery charging.

In some embodiments, the present disclosure provides a cleaning robot. The cleaning robot may include a recharging sensor configured to receive a recharging guidance signal transmitted by a charging base. The cleaning robot may also include a proximity sensor configured to detect surrounding obstacles of the cleaning robot through a contactless manner, the proximity sensor including a transmitter and a receiver, the receiver of the proximity sensor being configured to receive a first proximity signal. When the cleaning robot enters a recharging phase, the transmitter of the proximity sensor is shut down, and the receiver of the proximity sensor is maintained in an open state. The receiver of the proximity sensor of the cleaning robot is configured to receive the first proximity signal and the proximity sensor is configured to detect, in real time, a distance between the cleaning robot and the charging base based on the first proximity signal. The cleaning robot is configured to approach the charging base based on the distance between the cleaning robot and the charging base, and to dock with the charging base to perform battery charging. The charging base includes a transmitter configured to transmit a recharging guidance signal and the first proximity signal, the first proximity signal being transmitted during a transmission gap between transmissions of the recharging guidance signal.

In some embodiments, when the receiver of the proximity sensor receives the first proximity signal, the transmitter of the proximity sensor is started to transmit a second proximity signal toward the charging base, and the cleaning robot further includes a timer configured to record a transmitting time instance of the second proximity signal. The receiver receives the second proximity signal reflected by the charging base. The timer is also configured to record a receiving time instance when the reflected second proximity signal is received. The cleaning robot further includes a controller configured to determine a distance between the cleaning robot and the charging base based on the transmitting time instance of the second proximity signal, the receiving time instance of the second proximity signal, and a transmitting speed of the second proximity signal.

In some embodiments, the present disclosure provides a charging base including a transmitter configured to transmit a recharging guidance signal and a first proximity signal. The first proximity signal is transmitted by the transmitter during a transmission gap between transmissions of the recharging guidance signal. The first proximity signal is receivable by a receiver of a proximity sensor of a cleaning robot. The recharging guidance signal is receivable by a recharging sensor of the cleaning robot. In some embodiments, the charging base includes a reflector configured to reflect a second proximity signal transmitted by a transmitter of the proximity sensor of the cleaning robot.

In some embodiments, the present disclosure provides a cleaning robot system. The cleaning robot system includes a cleaning robot and a charging base. The charging base is provided with a transmitter configured to transmit a recharging guidance signal and a first proximity signal. The first proximity signal is transmitted by the transmitter of the charging base during a transmission gap between transmissions of the recharging guidance signal. The recharging guidance signal is receivable by a recharging sensor of the cleaning robot. The first proximity signal is receivable by a proximity sensor of the cleaning robot. The receiver of the proximity sensor of the cleaning robot is configured to receive the first proximity signal, and the proximity sensor is configured to detect a distance between the cleaning robot and the charging base based on the first proximity signal. The cleaning robot is configured to approach the charging base based on the distance between the cleaning robot and the charging base, and to dock with the charging base to perform battery charging. When the cleaning robot enters a recharging phase, the cleaning robot is configured to shut down a transmitter of the proximity sensor and maintain an open state of the receiver of the proximity sensor.

In some embodiments, the present disclosure provides a cleaning apparatus. The cleaning apparatus includes at least one processor and a storage device. The storage device is configured to store computer-executable instructions. The at least one processor is configured to execute the computer-executable instructions stored in the storage device to perform a recharging method disclosed herein.

A person having ordinary skills in the art can appreciate: all or some steps of the method embodiments can be implemented through hardware related to computer instructions. The above-described program may be stored in a computer-readable storage medium. When the program is executed, the steps of the method of the above various embodiments can be executed. The above-described storage medium may include: various media that can store program codes, such as ROM, RAM, magnetic disks or optic disks.

Finally, it should be noted that: the above embodiments are only used to explain the technical solutions of the present disclosure, and are not to limit the present disclosure; although detailed explanations have been provided for the present disclosure with reference to the above various embodiments, a person having ordinary skills in the art should understand: the person having ordinary skills in the art can modify the technical solutions described in the above various embodiments, or carry out equivalent replacement to some or all technical features. These modifications or replacements do not render relevant technical solutions to deviate from the scope of the technical solutions of various embodiments of the present disclosure.

What is claimed is:

1. A recharging method for a cleaning robot, comprising:

determining a direction of a charging base;

controlling the cleaning robot to move in a first direction toward the direction of the charging base to approach the charging base;

detecting, in real time, a distance between the cleaning robot and the charging base;

determining whether the cleaning robot has arrived at a target location based on the distance between the cleaning robot and the charging base, the target location being at a second predetermined distance in front of the charging base;

controlling the cleaning robot to rotate for a predetermined angle when the cleaning robot arrives at the target location;

controlling the cleaning robot to move backwardly to approach the charging base, and to touch the charging base;

after the cleaning robot touches the charging base and before the cleaning robot docks with the charging base, controlling the cleaning robot to move forwardly for a first predetermined distance; and after the cleaning robot moves forwardly for the first predetermined distance, controlling the cleaning robot to move backwardly to approach the charging base, and dock with the charging base to perform battery charging.

2. The recharging method of claim 1, wherein detecting, in real time, the distance between the cleaning robot and the charging base, and determining whether the cleaning robot has arrived at the target location based on the distance between the cleaning robot and the charging base, comprises:

shutting down, by the cleaning robot, a transmitter of a proximity sensor of the cleaning robot, and maintaining, by the cleaning robot, an open state of a receiver of the proximity sensor; and receiving, by the receiver of the proximity sensor of the cleaning robot, a first proximity signal, and determining, by the cleaning robot, whether the cleaning robot has arrived at the target location based on the first proximity signal, wherein the first proximity signal is transmitted by a transmitter on the charging base, and is receivable by the receiver of the proximity sensor on the cleaning robot, and wherein the first proximity signal is transmitted by the charging base during a transmission gap between transmissions of a recharging guidance signal.

3. The recharging method of claim 2, wherein determining whether the cleaning robot has arrived at the target location based on the first proximity signal comprises:

detecting, by the cleaning robot, whether the first proximity signal is received, and determining that the cleaning robot has arrived at the target location when the first proximity signal is detected; and/or detecting, by the cleaning robot, a signal strength of the first proximity signal, and determining that the cleaning robot has arrived at the target location when the signal strength is greater than or equal to a predetermined signal strength threshold value.

4. The recharging method of claim 3, further comprising:

while the cleaning robot moves toward the charging base, adjusting a motion pose based on the recharging guidance signal transmitted by the charging base, such that a moving direction of the cleaning robot aims at a center docking zone located right in front of the charging base.

5. The recharging method of claim 4, wherein the recharging guidance signal includes a directional guidance signal.

6. The recharging method of claim 2, wherein detecting, in real time, the distance between the cleaning robot and the charging base, and determining whether the cleaning robot has arrived at the target location based on the distance comprises:

detecting, by the cleaning robot, whether the receiver of the proximity sensor receives the first proximity signal, and determining, by the cleaning robot, whether the cleaning robot has arrived at the target location that is at the second predetermined distance in front of the charging base when the receiver detects the first proximity signal; and/or detecting, by the cleaning robot, the signal strength of the first proximity signal received by the receiver, and determining, by the cleaning robot, that the cleaning robot has arrived at the target location that is at the second predetermined distance in front of the charging base when the signal strength is greater than or equal to a predetermined signal strength threshold value.

7. The recharging method of claim 6, wherein detecting, in real time, the distance between the cleaning robot and the charging base comprises:

when the cleaning robot receives the first proximity signal, starting the transmitter of the proximity sensor, transmitting, by the transmitter of the proximity sensor, a second proximity signal toward the charging base, and recording a transmitting time instance of the second proximity signal;

reflecting, by a reflector of the charging base, the second proximity signal;

receiving, by the cleaning robot, the second proximity signal reflected back by the reflector of the charging base;

recording, by the cleaning robot, a receiving time instance of the received reflected second proximity signal; and determining, by the cleaning robot, the distance between the cleaning robot and the charging base based on the transmitting time instance of the second proximity signal, the receiving time instance of the second proximity signal, and a transmitting speed of the second proximity signal.

8. The recharging method of claim 1, wherein the first predetermined distance is in a range of 40 centimeters to 60 centimeters; and/or, wherein the second predetermined distance is in a range of 20 centimeters to 60 centimeters.

9. A cleaning robot system, comprising:

a charging base and a cleaning robot, wherein the cleaning robot comprises:

a determination device configured to determine a direction of the charging base;

a motion device configured to move the cleaning robot;

a detection device configured to detect, in real time, a distance between the cleaning robot and the charging base; and a controller configured to:

control the cleaning robot to move in a first direction toward the direction of the charging base to approach the charging base;

determine whether the cleaning robot has arrived at a target location based on the distance between the cleaning robot and the charging base, the target location being at a second predetermined distance in front of the charging base;

control the cleaning robot to rotate for a predetermined angle when the cleaning robot arrives at the target location;

control the cleaning robot to move backwardly to approach the charging base, and to touch the charging base;

after the cleaning robot touches the charging base and before the cleaning robot docks with the charging base, control the cleaning robot to move forwardly for a first predetermined distance; and after the cleaning robot moves forwardly for the first predetermined distance, control the cleaning robot to move backwardly to approach the charging base, and to dock with the charging base to perform battery charging.

10. The cleaning robot system of claim 9, wherein the charging base includes a transmitter configured to transmit a recharging guidance signal and a first proximity signal, the first proximity signal being transmitted during a transmission gap between transmissions of the recharging guidance signal.

11. The cleaning robot system of claim 10, wherein the detection device is a proximity sensor, and the proximity sensor includes a receiver configured to receive the first proximity signal transmitted by the transmitter of the charging base.

12. The cleaning robot system of claim 11, wherein the proximity sensor incudes a transmitter configured to transmit a second proximity signal toward the charging base, the charging base includes a reflector configured to reflect the second proximity signal back to the cleaning robot, and the receiver of the proximity sensor of the cleaning robot is configured to receive the second proximity signal.

13. A non-transitory computer-readable storage medium storing computer-executable instructions, which when executed by a processor of a cleaning robot, cause the cleaning robot to perform a method comprising:

determining a direction of a charging base;

controlling the cleaning robot to move in a first direction toward the direction of the charging base to approach the charging base;

detecting, in real time, a distance between the cleaning robot and the charging base;

determining whether the cleaning robot has arrived at a target location based on the distance between the cleaning robot and the charging base, the target location being at a second predetermined distance in front of the charging base;

controlling the cleaning robot to rotate for a predetermined angle when the cleaning robot arrives at the target location;

controlling the cleaning robot to move backwardly to approach the charging base, and to touch the charging base;

after the cleaning robot touches the charging base and before the cleaning robot docks with the charging base, controlling the cleaning robot to move forwardly for a first predetermined distance; and after the cleaning robot moves forwardly for the first predetermined distance, controlling the cleaning robot to move backwardly to approach the charging base, and dock with the charging base to perform battery charging.

14. The non-transitory computer-readable storage medium of claim 13, wherein detecting, in real time, the distance between the cleaning robot and the charging base, and determining whether the cleaning robot has arrived at the target location based on the distance between the cleaning robot and the charging base, comprises:

shutting down, by the cleaning robot, a transmitter of a proximity sensor of the cleaning robot, and maintaining, by the cleaning robot, an open state of a receiver of the proximity sensor; and receiving, by the receiver of the proximity sensor of the cleaning robot, a first proximity signal, and determining, by the cleaning robot, whether the cleaning robot has arrived at the target location based on the first proximity signal, wherein the first proximity signal is transmitted by a transmitter on the charging base, and is receivable by the receiver of the proximity sensor on the cleaning robot, and wherein the first proximity signal is transmitted by the charging base during a transmission gap between transmissions of a recharging guidance signal.

15. The non-transitory computer-readable storage medium of claim 14, wherein determining whether the cleaning robot has arrived at the target location based on the first proximity signal comprises:

detecting, by the cleaning robot, whether the first proximity signal is received, and determining that the cleaning robot has arrived at the target location when the first proximity signal is detected; and/or detecting, by the cleaning robot, a signal strength of the first proximity signal, and determining that the cleaning robot has arrived at the target location when the signal strength is greater than or equal to a predetermined signal strength threshold value.

16. The non-transitory computer-readable storage medium of claim 15, wherein the method further comprises:

while the cleaning robot moves toward the charging base, adjusting a motion pose based on the recharging guidance signal transmitted by the charging base, such that a moving direction of the cleaning robot aims at a center docking zone located right in front of the charging base.

17. The non-transitory computer-readable storage medium of claim 15, wherein the recharging guidance signal includes a directional guidance signal.

18. The non-transitory computer-readable storage medium of claim 14, wherein detecting, in real time, the distance between the cleaning robot and the charging base, and determining whether the cleaning robot has arrived at the target location based on the distance comprises:

detecting, by the cleaning robot, whether the receiver of the proximity sensor receives the first proximity signal, and determining, by the cleaning robot, whether the cleaning robot has arrived at the target location that is at the second predetermined distance in front of the charging base when the receiver detects the first proximity signal; and/or detecting, by the cleaning robot, the signal strength of the first proximity signal received by the receiver, and determining, by the cleaning robot, that the cleaning robot has arrived at the target location that is at the second predetermined distance in front of the charging base when the signal strength is greater than or equal to a predetermined signal strength threshold value.

19. The non-transitory computer-readable storage medium of claim 18, wherein detecting, in real time, the distance between the cleaning robot and the charging base comprises:

when the cleaning robot receives the first proximity signal, starting the transmitter of the proximity sensor, transmitting, by the transmitter of the proximity sensor, a second proximity signal toward the charging base, and recording a transmitting time instance of the second proximity signal;

receiving, by the cleaning robot, the second proximity signal reflected back by a reflector of the charging base;

recording, by the cleaning robot, a receiving time instance of the received reflected second proximity signal; and determining, by the cleaning robot, the distance between the cleaning robot and the charging base based on the transmitting time instance of the second proximity signal, the receiving time instance of the second proximity signal, and a transmitting speed of the second proximity signal.

20. The non-transitory computer-readable storage medium of claim 13, wherein the first predetermined distance is in a range of 40 centimeters to 60 centimeters; and/or, wherein the second predetermined distance is in a range of 20 centimeters to 60 centimeters.

* * * * *